US011138840B2

(12) United States Patent
Elias et al.

(10) Patent No.: US 11,138,840 B2
(45) Date of Patent: Oct. 5, 2021

(54) SYSTEMS AND METHODS FOR ASSOCIATING GAME SYMBOLS

(71) Applicant: Roxor Gaming Limited, London (GB)

(72) Inventors: Hans Elias, St Albans (GB); Thomas David James Aicken, London (GB); Marlon James Dublin, Ilford (GB)

(73) Assignee: Roxor Gaming, Ltd., London (GB)

( * ) Notice: Subject to any disclaimer, the term of this patent is extended or adjusted under 35 U.S.C. 154(b) by 0 days.

(21) Appl. No.: 16/220,310

(22) Filed: Dec. 14, 2018

(65) Prior Publication Data

US 2019/0122505 A1 Apr. 25, 2019

Related U.S. Application Data

(63) Continuation of application No. 13/943,999, filed on Jul. 17, 2013, now abandoned.

(60) Provisional application No. 61/790,413, filed on Mar. 15, 2013.

(51) Int. Cl.
*G07F 17/34* (2006.01)

(52) U.S. Cl.
CPC ..... *G07F 17/34* (2013.01)

(58) Field of Classification Search
CPC ..... G07F 17/34
See application file for complete search history.

(56) References Cited

U.S. PATENT DOCUMENTS

| | | | |
|---|---|---|---|
| 2003/0203752 | A1 | 10/2003 | Kaminkow |
| 2005/0215311 | A1 | 9/2005 | Hornik |
| 2006/0073876 | A1 | 4/2006 | Cuddy |
| 2014/0179395 | A1 | 6/2014 | Melnick |
| 2014/0274291 | A1 | 9/2014 | Elias |

OTHER PUBLICATIONS

Office Action for U.S. Appl. No. 13/943,999 dated Mar. 3, 2015; 8 pps.
Office Action for U.S. Appl. No. 13/943,999 dated Jun. 26, 2015; 11 pps.
Final Office Action for U.S. Appl. No. 13/943,999 dated Sep. 30, 2015; 6 pps.
Examiner's Answer to Appeal for U.S. Appl. No. 13/943,999 dated Nov. 4, 2016; 9 pps.
Decision on Appeal for U.S. Appl. No. 13/943,999 dated Oct. 16, 2018; 18 pps.

*Primary Examiner* — Kevin Y Kim
(74) *Attorney, Agent, or Firm* — RowanTree Law Group, PLLC; Carson C. K. Fincham

(57) ABSTRACT

Systems, methods, and articles of manufacture provide for associating game symbols. For example, scatter symbols and/or other reel symbols in a slot-style game may be related such that they become connected in relation to one or more results and/or outcomes of a game session.

10 Claims, 21 Drawing Sheets

Copyright © 2013 Gamesys Ltd.

Copyright © 2013 Gamesys Ltd.

Copyright © 2013 Gamesys Ltd.

Copyright © 2013 Gamesys Ltd.

Copyright © 2013 Gamesys Ltd.

Copyright © 2013 Gamesys Ltd.

Copyright © 2013 Gamesys Ltd.

Copyright © 2013 Gamesys Ltd.

Copyright © 2013 Gamesys Ltd.

SYSTEMS AND METHODS FOR ASSOCIATING GAME SYMBOLS

CROSS-REFERENCE TO RELATED APPLICATIONS

This application claims benefit and priority to, and is a continuation of, U.S. patent application Ser. No. 13/943,999 filed on Jul. 17, 2013 and titled "SYSTEMS AND METHODS FOR ASSOCIATING GAME SYMBOLS", which itself claims benefit and priority to and is a non-provisional of, U.S. Provisional Patent Application No. 61/790,413 filed on Mar. 15, 2013 and titled "SYSTEMS AND METHODS FOR ASSOCIATING GAME SYMBOLS", the entirety of each of which is hereby incorporated by reference herein.

COPYRIGHT NOTICE

A portion of the disclosure of this patent document contains material which is subject to copyright protection. The copyright owner has no objection to the facsimile reproduction by any-one of the patent document or the patent disclosure, as it appears in the Patent and Trademark Office patent file or records, but otherwise reserves all copyright rights whatsoever.

BACKGROUND

Game play and gaming tournaments for various types of games such as online, offline, skill-based, games of chance, and games of mixed skill and chance are a continued source of entertainment to game players, and are often a source of great revenue for gaming companies. Accordingly, there is a desire to provide players with increasingly newer, more interesting, engaging, or entertaining games.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

Figure 1:
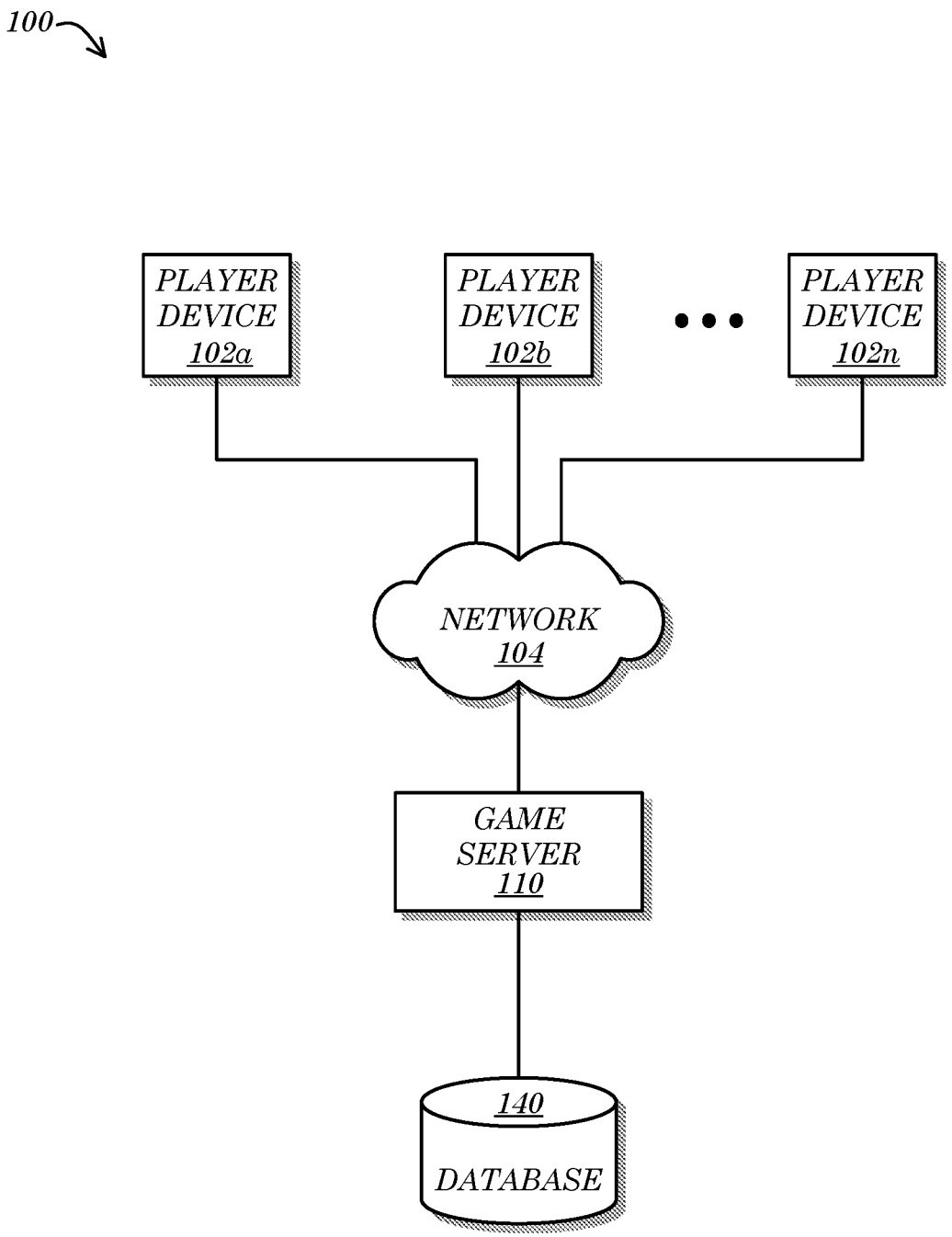
FIG. 1 is a block diagram of a system according to some embodiments.

Embodiments presented herein are descriptive of systems, apparatus, methods, and articles of manufacture for associating game symbols. In some embodiments, scatter symbols and/or other reel symbols in a slot-style game may be related such that they become connected in relation to one or more results and/or outcomes of a game session.

Throughout the description herein and unless otherwise specified, the following terms may include and/or encompass the example meanings provided. These terms and illustrative example meanings are provided to clarify the language selected to describe embodiments both in the specification and in the appended claims, and accordingly, are not intended to be generally limiting. While not generally limiting and while not limiting for all described embodiments, in some embodiments, the terms are specifically limited to the example definitions and/or examples provided. Other terms are defined throughout the present description.

A "game", as the term is used herein (unless specified otherwise), may generally comprise any game (e.g., wagering or non-wagering, electronically playable over a network) playable by one or more players in accordance with specified rules. A game may be playable on a Personal Computer (PC) online in web browsers, on a game console and/or on a mobile device such as a smart-phone or tablet computer. "Gaming" thus generally refers to play of a game.

A "casual game", as the term is used herein (unless specified otherwise), may generally comprise a game with simple rules with little or no time commitment on the time of a player to play. A casual game may feature, for example, very simple game play such as a puzzle or Scrabble™ game, may allow for short bursts of play (e.g., during work breaks), an ability to quickly reach a final stage and/or continuous play without a need to save the game.

A "social network game", as used herein (unless specified otherwise), generally refers to a type of online game that is played through a social network, and in some embodiments may feature multiplayer and asynchronous game play mechanics. A "social network" may refer to an online service, online community, platform, or site that focuses on facilitating the building of social networks or social relations among people. A social network service may, for example, consist of a representation of each user (often a profile), his/her social links, and a variety of additional services. A social network may be web-based and provide means for users to interact over the Internet, such as e-mail and instant messaging. A social network game may in some embodiments be implemented as a browser game, but can also be implemented on other platforms such as mobile devices.

A "wagering game", as the term is used herein (unless specified otherwise), may generally comprise a game on which a player can risk a wager or other consideration, such as, but not limited to: slot games, poker games, blackjack, baccarat, craps, roulette, lottery, bingo, keno, casino war, etc. A wager may comprise a monetary wager in the form of an amount of currency or any other tangible or intangible article having some value which may be risked on an outcome of a wagering game. "Gambling" or "wagering" generally refers to play of a wagering game.

The term "game provider", as used herein (unless specified otherwise), generally refers to an entity or system of components which provides games for play and facilitates play of such game by use of a network such as the Internet or a proprietary or closed networks (e.g., an intranet or wide area network). For example, a game provider may operate a website which provides games in a digital format over the Internet. In some embodiments in which a game comprising a wagering game is provided, a game provider may operate a gambling website over which wagers are accepted and results of wagering games are provided.

As utilized herein, the term "player" may generally refer to any type, quantity, and or manner of entity associated with the play of a game. In some embodiments, a player may comprise an entity conducting play of an online game, for example, may comprise an entity that desires to play a game (e.g., an entity registered and/or scheduled to play and/or an entity having expressed interest in the play of the game—e.g., a spectator) and/or may comprise an entity that configures, manages, and/or conducts a game. A player may be currently playing a game or have previously played the game, or may not yet have initiated play—i.e., a "player" may comprise a "potential player" (e.g., in general and/or with respect to a specific game). In some embodiments, a player may comprise a user of an interface (e.g., whether or not such a player participates in a game or seeks to participate in the game). In some embodiments, a player may comprise an individual (or group) that enters, joins, logs into, registers for, and/or otherwise access an online game room, session, server, and/or other particular instance and/or segmentation of an online game.

Some embodiments described herein are associated with a "player device" or a "network device". As used herein, a "player device" is a subset of a "network device". The "network device", for example, may generally refer to any device that can communicate via a network, while the "player device" may comprise a network device that is owned and/or operated by or otherwise associated with a player. Examples of player and/or network devices may include, but are not limited to: a PC, a computer workstation, a computer server, a printer, a scanner, a facsimile machine, a copier, a Personal Digital Assistant (PDA), a storage device (e.g., a disk drive), a hub, a router, a switch, and a modem, a video game console, or a wireless or cellular telephone. Player and/or network devices may, in some embodiments, comprise one or more network components.

As used herein, the term "network component" may refer to a player or network device, or a component, piece, portion, or combination of player or network devices. Examples of network components may include a Static Random Access Memory (SRAM) device or module, a network processor, and a network communication path, connection, port, or cable.

In addition, some embodiments are associated with a "network" or a "communication network." As used herein, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. Networks may be or include a plurality of interconnected network devices. In some embodiments, networks may be hard-wired, wireless, virtual, neural, and/or any other configuration or type that is or becomes known. Communication networks may include, for example, devices that communicate directly or indirectly, via a wired or wireless medium such as the Internet, intranet, a Local Area Network (LAN), a Wide Area Network (WAN), a cellular telephone network, a Bluetooth® network, a Near-Field Communication (NFC) network, a Radio Frequency (RF) network, a Virtual Private Network (VPN), Ethernet (or IEEE 802.3), Token Ring, or via any appropriate communications means or combination of communications means. Exemplary protocols include but are not limited to: Bluetooth™, Time Division Multiple Access (TDMA), Code Division Multiple Access (CDMA), Global System for Mobile communications (GSM), Enhanced Data rates for GSM Evolution (EDGE), General Packet Radio Service (GPRS), Wideband CDMA (WCDMA), Advanced Mobile Phone System (AMPS), Digital AMPS (D-AMPS), IEEE 802.11 (WI-FI), IEEE 802.3, SAP, the best of breed (BOB), and/or system to system (S2S).

As used herein, the terms "information" and "data" may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard. Information may, according to some embodiments, be compressed, encoded, encrypted, and/or otherwise packaged or manipulated in accordance with any method that is or becomes known or practicable.

The term "indication", as used herein (unless specified otherwise), may generally refer to any indicia and/or other information indicative of or associated with a subject, item, entity, and/or other object and/or idea. As used herein, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and/or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

A "session", as the term is used herein (unless indicated otherwise), may generally comprise a period of time spanning a plurality of event instances or turns of a game, the session having a defined start and defined end. An event instance or turn is triggered upon an initiation of, or request for, at least one result of the game by a player, such as an actuation of a "start" or "spin" mechanism, which initiation causes an outcome to be determined or generated (e.g., a random number generator is contacted or communicated with to identify, generate or determine a random number to be used to determine a result for the event instance). In some embodiments, a session may initiate upon a player providing and/or inputting (and an associated gaming device accordingly receiving) one or more identifiers and/or credentials (e.g., logging-in) and/or may end or terminate upon a logging-out of the player (either explicitly or implicitly—such as by ceasing play, running out of credits/spins, and/or becoming inactive for more than a threshold period of time).

As used herein, the terms "outcome" and "result" should be differentiated in the present description in that an "outcome" is generally a representation of a "result", typically comprising one or more game elements or game symbols. For example, in a "fruit themed" game, a winning outcome (i.e., an outcome corresponding to some kind of award, prize or payout) may comprise a combination of three "cherry" symbols. The "result" of this outcome may be a payout of X credits awarded to the player associated with the game. In another example, in a game in which a character moves along a game interface from a starting position to a finish position, an "outcome" of the game may comprise a symbol representing one or more movements along the interface and the "result" corresponding to this outcome may be the particular number and direction of the character's movement (e.g., three (3) spaces backwards such that the character ends up further away from the finish line). In a session embodiment, a session result may comprise a binary result (e.g., a player or game character wins or loses the session) and/or the particular award (or magnitude of award) won or earned by the player based on the session (e.g., the number of credits awarded to the player). It should be noted that the embodiments described herein encompass awards, prizes and payouts which are monetary, non-monetary, tangible or intangible.

As used herein, the term "virtual currency" may generally refer to an in-game currency that may be used as part of a game or one or more games provided by a game provider as (i) currency for making wagers, and/or (ii) to purchase or access various in-game items, features or powers.

A "credit balance", as the term is used herein (unless indicated otherwise), may generally refer to (i) a balance of currency, whether virtual currency and/or real currency, usable for making wagers in a game and/or (ii) another tracking mechanism for tracking a player's success or advancement in a game by deducting there from points or value for unsuccessful attempts at advancement and adding thereto points or value for successful attempts at advancement.

Turning first to FIG. 1, a block diagram of a system 100 according to some embodiments is shown. In some embodiments, the system 100 may comprise a gaming platform such as a gaming platform via which one or more multiplayer, casual, social network, wagering, and/or online games may be played. In some embodiments, the system 100 may comprise a plurality of player devices 102*a-n* in communication with and/or via a network 104. In some embodiments, a game server 110 may be in communication with the network 104 and/or one or more of the player devices 102*a-n*. In some embodiments, the game server 110 (and/or the player devices 102*a-n*) may be in communication with a database 140. The database 140 may store, for example, game date (e.g., processed and/or defined by the game server 110), data associated with players (not explicitly shown) owning and/or operating the player devices 102*a-n*, and/or instructions that cause various devices (e.g., the game server 110 and/or the player devices 102*a-n*) to operate in accordance with embodiments described herein (e.g., to provide a slot-style game having expanding and/or otherwise associated symbols as described herein).

According to some embodiments, any or all of the components 102*a-n*, 104, 110, 140 of the system 100 may be similar in configuration and/or functionality to any similarly named and/or numbered components described herein. Fewer or more components 102*a-n*, 104, 110, 140 (and/or portions thereof) and/or various configurations of the components 102*a-n*, 104, 110, 140 may be included in the system 100 without deviating from the scope of embodiments described herein. While multiple instances of some components 102*a-n* are depicted and while single instances of other components 104, 110, 140 are depicted, for example, any component 102*a-n*, 104, 110, 140 depicted in the system 100 may comprise a single device, a combination of devices and/or components 102*a-n*, 104, 110, 140, and/or a plurality of devices, as is or becomes desirable and/or practicable. Similarly, in some embodiments, one or more of the various components 102*a-n*, 104, 110, 140 may not be needed and/or desired in the system 100. In some embodiments, the system 100 may be configured and/or utilized to implement and/or facilitate the method 800 of FIG. 8, or one or more portions thereof.

The player devices 102*a-n*, in some embodiments, may comprise any type or configuration of electronic, mobile electronic, and or other network and/or communication devices (or combinations thereof) that are or become known or practicable. A first player device 102*a* may, for example, comprise one or more PC devices, computer workstations (e.g., game consoles and/or gaming computers), tablet computers, such as an iPad® manufactured by Apple®, Inc. of Cupertino, Calif., and/or cellular and/or wireless telephones such as an iPhone® (also manufactured by Apple®, Inc.) or an Optimus™ S smart phone manufactured by LG® Electronics, Inc. of San Diego, Calif., and running the Android® operating system from Google®, Inc. of Mountain View, Calif. In some embodiments, one or more of the player devices 102*a-n* may be specifically utilized and/or configured (e.g., via specially-programmed and/or stored instructions such as may define or comprise a software application) to communicate with the game server 110 (e.g., via the network 104).

The network 104 may, according to some embodiments, comprise a LAN, WAN, cellular telephone network, Bluetooth® network, NFC network, and/or RF network with communication links between the player devices 102*a-n*, the game server 110, and/or the database 140. In some embodiments, the network 104 may comprise direct communications links between any or all of the components 102*a-n*, 110, 140 of the system 100. The game server 110 may, for example, be directly interfaced or connected to the database 140 via one or more wires, cables, wireless links, and/or other network components, such network components (e.g., communication links) comprising portions of the network 104. In some embodiments, the network 104 may comprise one or many other links or network components other than those depicted in FIG. 1. A second player device 102*b* may, for example, be connected to the game server 110 via various cell towers, routers, repeaters, ports, switches, and/or other network components that comprise the Internet and/or a cellular telephone (and/or Public Switched Telephone Network (PSTN)) network, and which comprise portions of the network 104.

While the network 104 is depicted in FIG. 1 as a single object, the network 104 may comprise any number, type, and/or configuration of networks that is or becomes known or practicable. According to some embodiments, the network 104 may comprise a conglomeration of different sub-networks and/or network components interconnected, directly or indirectly, by the components 102*a-n*, 110, 140 of the system 100. The network 104 may comprise one or more cellular telephone networks with communication links between the player devices 102*a-n* and the game server 110, for example, and/or may comprise the Internet, with communication links between the player devices 102*a-n* and the database 140, for example.

According to some embodiments, the game server 110 may comprise a device (and/or system) owned and/or operated by or on behalf of or for the benefit of a game provider and/or gaming entity (not explicitly shown). The game provider may utilize player and/or game information or instructions (e.g., stored by the database 140), in some embodiments, to host, manage, analyze, design, define, price, conduct, and/or otherwise provide (or cause to be provided) one or more games such as online multiplayer games, causal games, wagering games, and/or social network games. In some embodiments, the game provider (and/or a third-party; not explicitly shown) may provide an interface (not shown in FIG. 1; e.g., the interfaces 620, 720, 920*a-d*, 1020*a-e* of FIG. 6, FIG. 7, FIG. 9A, FIG. 9B, FIG. 9C, FIG. 9D, FIG. 10A, FIG. 10B, FIG. 10C, FIG. 10D, and/or FIG. 10E herein) to and/or via the player devices 102*a-n*. The interface may be configured, according to some embodiments, to allow and/or facilitate electronic game play by one or more players. In some embodiments, the system 100 (and/or interface provided by the game server 110) may present game data (e.g., from the database 140) in such a manner that allows players to participate in one or more online and/or other games (singularly, in/with groups, and/or otherwise). According to some embodiments, the game server 110 may cause, implement, and/or output associated game symbols, as described herein.

In some embodiments, the database 140 may comprise any type, configuration, and/or quantity of data storage devices that are or become known or practicable. The database 140 may, for example, comprise an array of optical and/or solid-state hard drives configured to store player and/or game data, and/or various operating instructions, drivers, etc. While the database 140 is depicted as a standalone component of the system 100 in FIG. 1, the database 140 may comprise multiple components. In some embodiments, a multi-component database 140 may be distributed across various devices and/or may comprise remotely dispersed components. Any or all of the player devices 102*a-n* may comprise the database 140 or a portion thereof, for example, and/or the game server 110 may comprise the database 140 or a portion thereof.

Figure 2:
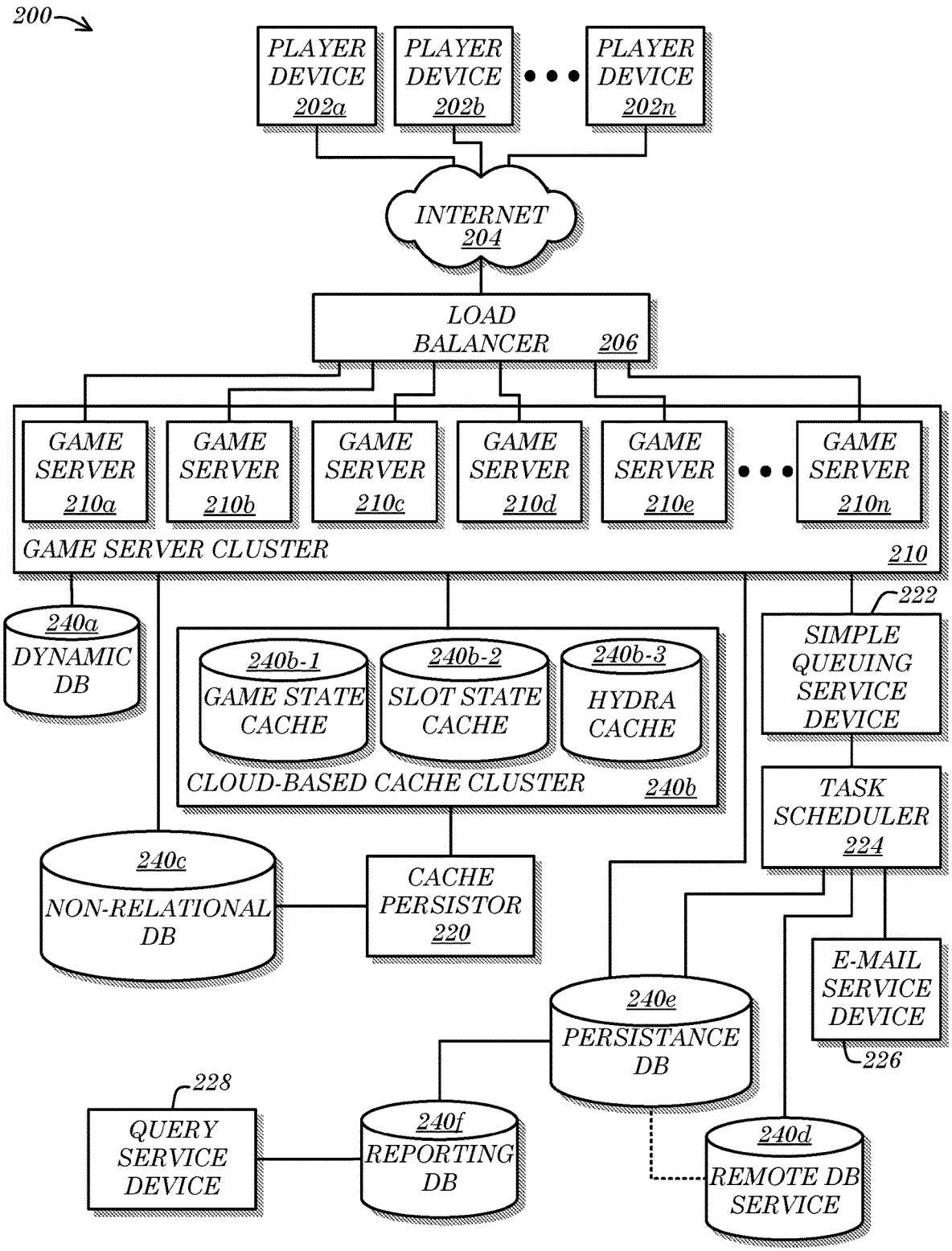
FIG. 2 is a block diagram of a system according to some embodiments.

Referring now to FIG. 2, a block diagram of a system 200 according to some embodiments is shown. In some embodiments, the system 200 may comprise a gaming platform such as a platform via which social network, wagering, casual, multiplayer, and/or online games may be played. In some embodiments, the system 200 may comprise a plurality of player devices 202*a-n*, the Internet 204, a load balancer 206, and/or a game server cluster 210. The game server cluster 210 may, in some embodiments, comprise a plurality of game servers 210*a-n*. In some embodiments, the system 200 may comprise a cache persistor 220, a Simple Queuing Service (SQS) device 222, a task scheduler 224, an e-mail service device 226, and/or a query service device 228. As depicted in FIG. 2, any or all of the various components 202*a-n*, 204, 206, 210*a-n*, 220, 222, 224, 226, 228 may be in communication with and/or coupled to one or more databases 240*a-f*. The system 200 may comprise, for example, a dynamic DataBase (DB) 240*a*, a cloud-based cache cluster 240*b* (e.g., comprising a game state cache 240*b*-1, a slot state cache 240*b*-2, and/or a "hydra" cache 240*b*-3), a non-relational DB 240*c*, a remote DB service 240*d*, a persistence DB 240*e*, and/or a reporting DB 240*f*.

According to some embodiments, any or all of the components 202*a-n*, 204, 206, 210*a-n*, 220, 222, 224, 226, 228, 240*a-f* of the system 200 may be similar in configuration and/or functionality to any similarly named and/or numbered components described herein. Fewer or more components 202*a-n*, 204, 206, 210*a-n*, 220, 222, 224, 226, 228, 240*a-f* (and/or portions thereof) and/or various configurations of the components 202*a-n*, 204, 206, 210*a-n*, 220, 222, 224, 226, 228, 240*a-f* may be included in the system 200 without deviating from the scope of embodiments described herein. While multiple instances of some components 202*a-n*, 210*a-n*, 240*a-f* are depicted and while single instances of other components 204, 206, 220, 222, 224, 226, 228 are depicted, for example, any component 202*a-n*, 204, 206, 210*a-n*, 220, 222, 224, 226, 228, 240*a-f* depicted in the system 200 may comprise a single device, a combination of devices and/or components 202*a-n*, 204, 206, 210*a-n*, 220, 222, 224, 226, 228, 240*a-f*, and/or a plurality of devices, as is or becomes desirable and/or practicable. Similarly, in some embodiments, one or more of the various components 202*a-n*, 204, 206, 210*a-n*, 220, 222, 224, 226, 228, 240*a-f* may not be needed and/or desired in the system 200. In some embodiments, the system 200 may be configured and/or utilized to implement and/or facilitate the method 800 of FIG. 8, or one or more portions thereof According to some embodiments, the player devices 202*a-n* may be utilized to access (e.g., via the Internet 204 and/or one or more other networks not explicitly shown) content provided by the game server cluster 210. The game server cluster 210 may, for example, provide, manage, host, and/or conduct various online and/or otherwise electronic games such as online bingo, slots, poker, and/or other games of chance, skill, and/or combinations thereof. In some embodiments, the various game servers 210*a-n* (virtual and/or physical) of the game server cluster 210 may be configured to provide, manage, host, and/or conduct individual instances and/or sessions of available game types. A first game server 210*a*, for example, may host a first particular session of an online bingo game (or tournament), a second game server 210*c* may host a second particular session of an online bingo game (or tournament), a third game server 210*c* may facilitate an online poker tournament (e.g., and a corresponding plurality of game sessions that comprise the tournament), and/or a fourth game server 210*d* may provide an online slots game (e.g., by hosting one or more slot game sessions).

In some embodiments, the player devices 202*a-n* may comprise various components (hardware, firmware, and/or software; not explicitly shown) that facilitate game play and/or interaction with the game server cluster 210. The player device 202*a-n* may, for example, comprise a gaming client such as a software application programmed in Adobe® Flash® and/or HTML 5 that is configured to send requests to, and receive responses from, one or more of the game servers 210*a-n* of the game server cluster 210. In some embodiments, such an application operating on and/or via the player devices 202*a-n* may be configured in Model-View-Controller (MVC) architecture with a communication manager layer responsible for managing the requests to/responses from the game server cluster 210. In some embodiments, one or more of the game servers 210*a-n* may also or alternatively be configured in a MVC architecture with a communication manager and/or communications management layer (not explicitly shown in FIG. 2). In some embodiments, communications between the player devices 202*a-n* and the game server cluster 210 may be conducted in accordance with the HyperText Transfer Protocol (HTTP) version 1.1 (HTTP/1.1) as published by the Internet Engineering Taskforce (IET) and the World Wide Web Consortium (W3C) in RFC 2616 (June 1999).

According to some embodiments, communications between the player devices 202*a-n* and the game server cluster 210 may be managed and/or facilitated by the load balancer 206. The load balancer 206 may, for example, route communications from player devices 202*a-n* to one or more of the specific game servers 210*a-n* depending upon various attributes and/or variables such as bandwidth availability (e.g., traffic management/volumetric load balancing), server load (e.g., processing load balancing), server functionality (e.g., contextual awareness/availability), and/or player-server history (e.g., session awareness/"stickiness"). In some embodiments, the load balancer 206 may comprise one or more devices and/or services provided by a third-party (not separately shown in FIG. 2). The load balancer 206 may, for example, comprise an Elastic Load Balancer (ELB) service provided by Amazon® Web Services, LLC of Seattle, Wash. According to some embodiments, such as in the case that the load balancer 206 comprises the ELB or a similar service, the load balancer 206 may manage, set, determine, define, and/or otherwise influence the number of game servers 210*a-n* within the game server cluster 210. In the case that traffic and/or requests from the player devices 202*a-n* only require the first and second game servers 210*a-b*, for example, all other game servers 210*c-n* may be taken off-line, may not be initiated and/or called, and/or may otherwise not be required and/or utilized in the system 200. As demand increases (and/or if performance, security, and/or other issues cause one or more of the first and second game servers 210*a-b* to experience detrimental issues), the load balancer 206 may call and/or bring online one or more of the other game servers 210*c-n* depicted in FIG. 2. In the case that each game server 210*a-n* comprises an instance of an Amazon® Elastic Compute Cloud (EC2) service, the load balancer 206 may add or remove instances as is or becomes practicable and/or desirable.

In some embodiments, the load balancer 206 and/or the Internet 204 may comprise one or more proxy servers and/or devices (not shown in FIG. 2) via which communications between the player devices 202*a-n* and the game server cluster 210 are conducted and/or routed. Such proxy servers and/or devices may comprise one or more regional game hosting centers, for example, which may be geographically dispersed and addressable by player devices 202*a-n* in a given geographic proximity. In some embodiments, the proxy servers and/or devices may be located in one or more geographic areas and/or jurisdictions while the game server cluster 210 (and/or certain game servers 210*a-n* and/or groups of game servers 210*a-n* thereof) is located in a separate and/or remote geographic area and/or jurisdiction.

According to some embodiments, for specific game types such as bingo, the game server cluster 210 may provide game results (such as a full set of drawn bingo numbers and/or bonus metrics) to a controller device (not separately shown in FIG. 2) that times the release of game result information to the player devices 202*a-n* such as by utilizing a broadcaster device (also not separately shown in FIG. 2) that transmits the time-released game results to the player devices 202*a-n* (e.g., in accordance with the Transmission Control Protocol (TCP) and Internet Protocol (IP) suite of communications protocols (TCP/IP), version 4, as defined by "Transmission Control Protocol" RFC 793 and/or "Internet Protocol" RFC 791, Defense Advance Research Projects Agency (DARPA), published by the Information Sciences Institute, University of Southern California, J. Postel, ed. (September 1981)).

In some embodiments, the game server cluster 210 (and/or one or more of the game servers 210*a-n* thereof) may be in communication with the dynamic DB 240*a*. According to some embodiments, the dynamic DB 240*a* may comprise a dynamically-scalable database service such as the DyanmoDB™ service provided by Amazon® Web Services, LLC. The dynamic DB 240*a* may, for example, store information specific to one or more certain game types (e.g., slots) provided by the game server cluster 210 such as to allow, permit, and/or facilitate reporting and/or analysis of such information.

According to some embodiments, the game server cluster 210 (and/or one or more of the game servers 210*a-n* thereof) may be in communication with the cloud-based cache cluster 240*b*. Game state information from the game server cluster 210 may be stored in the game state cache 240*b*-1, for example, slot state (e.g., slot-game specific state) data may be stored in the slot state cache 240*b*-2, and/or other game and/or player information (e.g., progressive data, referral data, player rankings, audit data) may be stored in the hydra cache 240*b*-3. In some embodiments, the cache persistor 220 may move and/or copy data stored in the cloud-based cache cluster 240*b* to the non-relational DB 240*c*. The non-relational DB 240*c* may, for example, comprise a SimpleDB™ service provided by Amazon® Wed Services, LLC. According to some embodiments, the game server cluster 210 may generally access the cloud-based cache cluster 240*b* as-needed to store and/or retrieve game-related information. The data stored in the cloud-based cache cluster 240*b* may generally comprise a subset of the newest or freshest data, while the cache persistor 220 may archive and/or store or move such data to the non-relational DB 240*c* as it ages and/or becomes less relevant (e.g., once a player logs-off, once a game session and/or tournament ends). The game server cluster 210 may, in accordance with some embodiments, have access to the non-relational DB 240*c* as-needed and/or desired. The game servers 210*a-n* may, for example, be initialized with data from the non-relational DB 240*c* and/or may store and/or retrieve low frequency and/or low priority data via the non-relational DB 240*c*.

In some embodiments, the SQS device 222 may queue and/or otherwise manage requests, messages, events, and/or other tasks or calls to and/or from the server cluster 210. The SQS device 222 may, for example, prioritize and/or route requests between the game server cluster 210 and the task scheduler 224. In some embodiments, the SQS device 222 may provide mini-game and/or tournament information to the server cluster 210. According to some embodiments, the task scheduler 224 may initiate communications with the SQS device 222, the e-mail service provider 226 (e.g., providing e-mail lists), the remote DB service 240*d* (e.g., providing inserts and/or updates), and/or the persistence DB 240*e* (e.g., providing and/or updating game, player, and/or other reporting data), e.g., in accordance with one or more schedules.

According to some embodiments, the persistence DB 240*e* may comprise a data store of live environment game and/or player data. The game server cluster 210 and/or the task scheduler 224 or SQS device 222 may, for example, store game and/or player data to the persistence DB 240*e* and/or may pull and/or retrieve data from the persistence DB 240*e*, as-needed and/or desired. The server cluster 210 may, according to some embodiments, provide and/or retrieve spin and/or other game event info and/or configuration information via the persistence DB 240*e*.

In some embodiments, the reporting DB 240*f* may be created and/or populated based on the persistence DB 240*e*. On a scheduled and/or other basis, for example, a data transformation and/or mapping program may be utilized to pull data from the live environment (e.g., the persistence DB 240*e*) into the reporting DB 240*f*. The query service 228 may then be utilized, for example, to query the reporting DB 240*f*, without taxing the live environment and/or production system directly accessible by the game server cluster 210.

Figure 3:
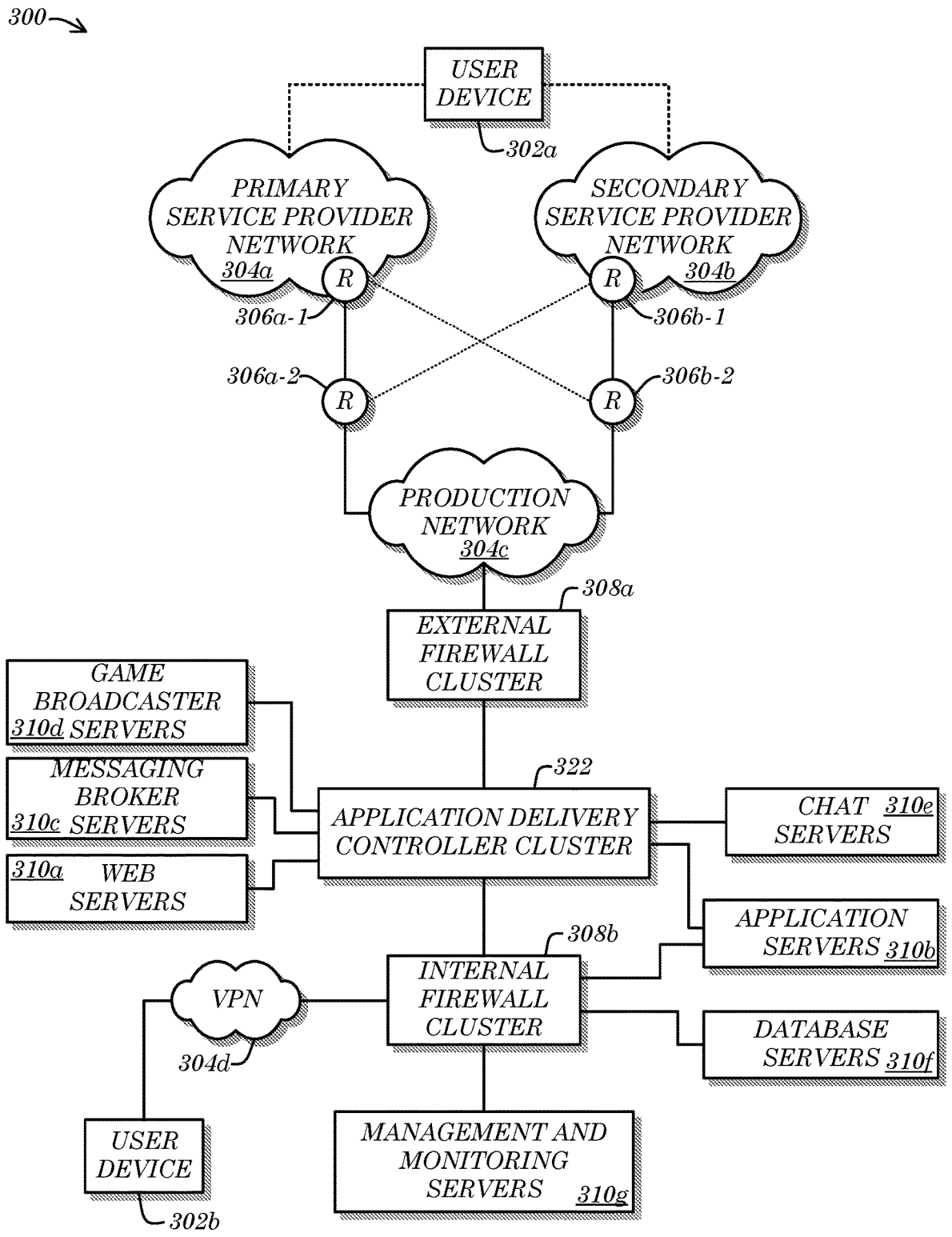
FIG. 3 is a block diagram of a system according to some embodiments.

Turning now to FIG. 3, a block diagram of a system 300 according to some embodiments is shown. In some embodiments, the system 300 may comprise and/or define a "front-end" architecture of a gaming platform such as a platform via which social network, causal, wagering, multiplayer, and/or online games may be played. In some embodiments, the system 300 may comprise a plurality of user devices 302*a-b*, a plurality of networks 304*a-b* (e.g., a primary service provider network 304*a*, a secondary service provider network 304*b*, a production network 304*c*, and/or a VPN 304*d*), a plurality of routers 306*a-b*, a plurality of firewall devices 308*a-b*, a plurality of game servers 310*a-g* (e.g., web servers 310*a*, application servers 310*b*, messaging broker servers 310*c*, game broadcaster servers 310*d*, chat servers 310*e*, database servers 310*f*, and/or management and monitoring servers 310*g*), and/or an application delivery controller cluster 322.

According to some embodiments, any or all of the components 302*a-b*, 304*a-b*, 306*a-b*, 308*a-b*, 310*a-g*, 322 of the system 300 may be similar in configuration and/or functionality to any similarly named and/or numbered components described herein. Fewer or more components 302*a-b*, 304*a-b*, 306*a-b*, 308*a-b*, 310*a-g*, 322 (and/or portions thereof) and/or various configurations of the components 302*a-b*, 304*a-b*, 306*a-b*, 308*a-b*, 310*a-g*, 322 may be included in the system 300 without deviating from the scope of embodiments described herein. While multiple instances of some components 302*a-b*, 304*a-b*, 306*a-b*, 308*a-b*, 310*a-g* are depicted and while single instances of other components 322 are depicted, for example, any component 302*a-b*, 304*a-b*, 306*a-b*, 308*a-b*, 310*a-g*, 322 depicted in the system 300 may comprise a single device, a combination of devices and/or components 302*a-b*, 304*a-b*, 306*a-b*, 308*a-b*, 310*a-g*, 322, and/or a plurality of devices, as is or becomes desirable and/or practicable. Similarly, in some embodiments, one or more of the various components 302*a-b*, 304*a-b*, 306*a-b*, 308*a-b*, 310*a-g*, 322 may not be needed and/or desired in the system 300. In some embodiments, the system 300 may be configured and/or utilized to implement and/or facilitate the method 800 of FIG. 8, or one or more portions thereof In some embodiments, a first user device 304*a* may comprise an electronic device owned and/or operated by a player of an online game (not explicitly shown) and/or by an entity that otherwise accesses online game content and/or services externally (e.g., requiring external login and/or access credentials and/or procedures). The first user device 304*a* may, for example, be utilized to access content provided by and/or via the application delivery controller cluster 322. In some embodiments, the first user device 304*a* may interface with and/or connect to the production network 304*c* via the primary service provider network 304*a* and/or the secondary service provider network 304*b*. The primary service provider network 304*a* and the secondary service provider network 304*b* may, for example, load balance and/or provide redundant coverage for outage recovery by utilization of a first primary service provider network router 306*a*-1, a second primary service provider network router 306*a*-2, a first secondary service provider network router 306*b*-1, and/or a second secondary service provider network router 306*b*-2.

According to some embodiments, the application delivery controller cluster 322 may be insulated and/or protected from the production network 304*c* by an external firewall cluster 308*a*. The first user device 304*a* may, for example, be required to provide credentials to and/or otherwise access the application delivery controller cluster 322 via the external firewall cluster 308*a*.

In some embodiments, the application delivery controller cluster 322 may receive via and/or from the external firewall cluster 308*a* and/or the production network 304*c*, one or more requests, calls, transmissions, and/or commands from the first user device 304*a*. The first user device 304*a* may, for example, submit a call for an online gaming interface to the application delivery controller cluster 322. In some embodiments, the application delivery controller cluster 322 may comprise one or more hardware, software, and/or firmware devices and/or modules configured (e.g., specially-programmed) to route events and/or responses between the first user device 304*a* and one or more of the servers 310*a-g*. In the case that the first user device 304*a* is utilized to access an online gaming interface (not explicitly shown in FIG. 3; e.g., the interfaces 620, 720, 920*a-d*, 1020*a-e* of FIG. 6, FIG. 7, FIG. 9A, FIG. 9B, FIG. 9C, FIG. 9D, FIG. 10A, FIG. 10B, FIG. 10C, FIG. 10D, and/or FIG. 10E herein) for example, one or more of the web servers 310*a* (e.g., that may provide graphical and/or rendering elements for an interface and/or other web services) and/or the application servers 310*b* (e.g., that may provide rule and/or logic-based programming routines, elements, and/or functions—e.g., game play engines) may be called and/or managed by the application delivery controller cluster 322.

In some embodiments, the messaging broker servers 310*c* may receive and/or retrieve messages from the first user device 304*a* (and/or from one or more of the other servers 310*a-b*, 310*d-g*) and perform one or more inter-application processes in relation thereto. The messaging broker servers 310*c* may, for example, route, transform, consolidate, aggregate, store, augment, and/or otherwise process one or more requests in connection with provision of online gaming services to the first user device 304*a* (e.g., facilitating a decoupling of services provided by various applications on and/or from the various servers 310*a-b*, 310*d-g*). According to some embodiments, the game broadcaster servers 310*d* may provide scheduled releases of information descriptive of an online game. The game broadcaster servers 310*d* may, for example, provide a broadcast feed of bingo numbers, slot and/or other random (and/or pseudo-random) number results that may be accessed by (and/or transmitted to) the first user device 304*a* (e.g., in connection with the play of an online bingo, slots, and/or other game for which broadcast information may be utilized). In some embodiments, the chat servers 310*e* may provide, manage, and/or facilitate communications between the first user device 304*a* (and/or first user thereof) and one or more other player/user devices (such as a second user device 302*b* and/or other player/user devices not shown in FIG. 3).

According to some embodiments, the second user device 304*b* may generally comprise an electronic device owned and/or operated by a user (not shown) closely affiliated with an entity that operates the system 300 (such entity also not shown; e.g., a game provider). An employee (e.g., programmer and/or Customer Service Representative (CSR)), contractor, and/or other agent of an online gaming company and/or other game provider may, for example, utilize the second user device 304*b* to interface with the privately-accessible VPN 304*d*. The VPN 304*d* may, for example, provide direct access to the application servers 310*b*, the database servers 310*f*, the management and monitoring servers 310*g*, and/or the application delivery controller cluster 322. In some embodiments (as depicted in FIG. 3), such access may be gated through and/or insulated or protected by an internal firewall cluster 308*b*. The second user device 304*b* may, for example, be required to provide credentials to and/or otherwise access the application delivery controller cluster 322 and/or servers 310*a-g* via the internal firewall cluster 308*b*.

In some embodiments, the database servers 310*f* may provide access to one or more databases and/or data stores (e.g., not shown in FIG. 3; for data storage and/or retrieval). In some embodiments, the management and monitoring servers 310*g* may provide services such as monitoring, reporting, troubleshooting, analysis, configuring, etc. to the second user device 304*b*. The second user device 304*b* may, for example, access the management and monitoring servers 310*g* and/or the database servers 310*f* to run reports descriptive of online gaming operations, game play, and/or game referral setup, management, and/or analysis. According to some embodiments, either or both of the user devices 304*a-b* in conjunction with one or more of the servers 310*a-g* and/or the application delivery controller cluster 322 may conduct (in whole or in part), facilitate, and/or otherwise be associated with execution of one or more stored procedures, applications, processes, and/or methods.

Utilization of the term "server" with respect to the servers 310*a-g* of the system 300 of FIG. 3 is meant solely to ease description of the configuration and/or functionality of the servers 310*a-g*. The term "server" is not intended to be limiting with respect to any particular hardware, software, firmware, and/or quantities thereof utilized to implement any or all of the servers 310*a-g* of the system 300. Similarly, while multiple types and/or instances of the severs 310*a-g* are depicted in FIG. 3, any or all of the servers 310*a-g* may be implemented in, on, and/or by one or multiple computer server and/or other electronic devices.

Figure 4:
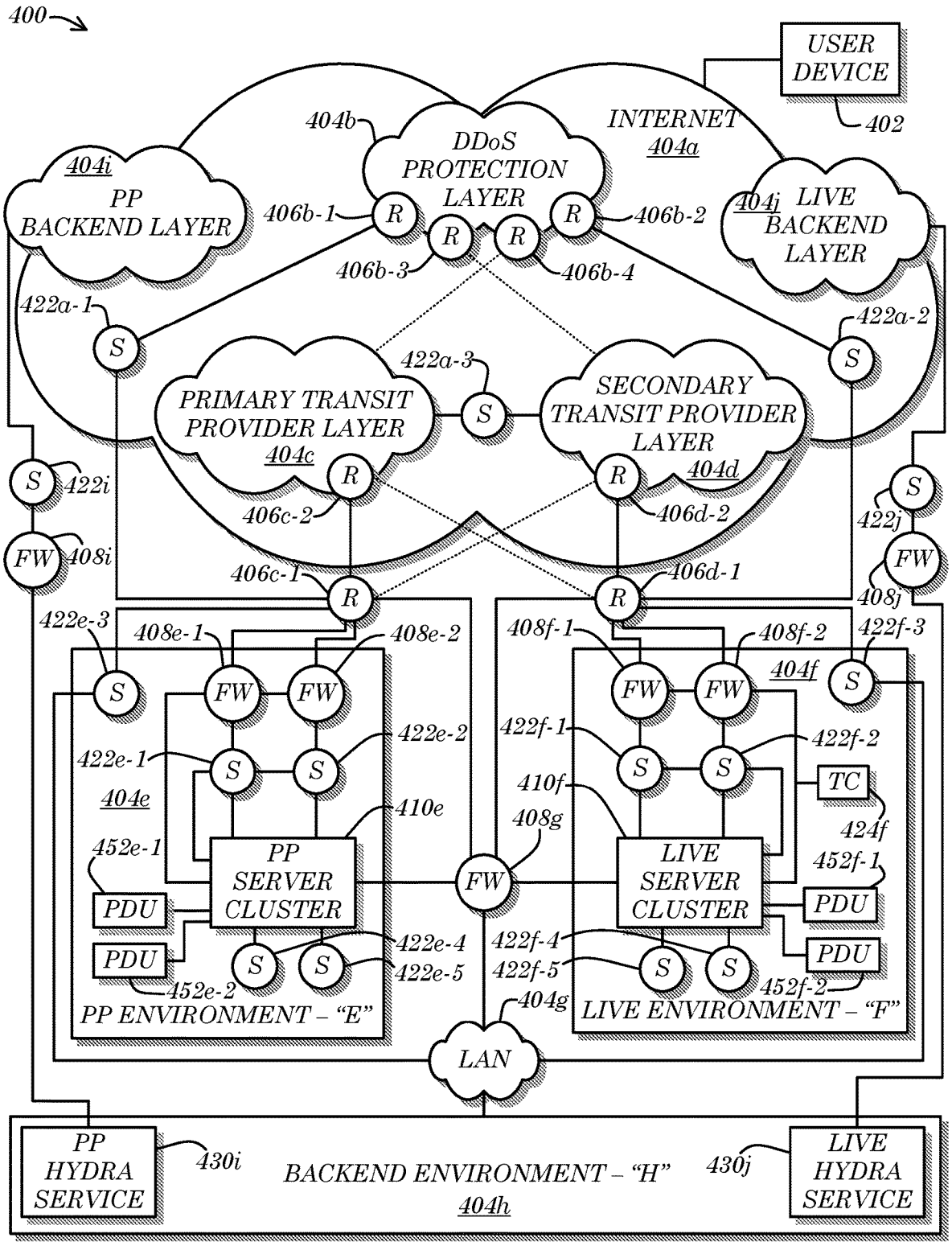
FIG. 4 is a block diagram of a system according to some embodiments.

Referring now to FIG. 4, a block diagram of a system 400 according to some embodiments is shown. In some embodiments, the system 400 may comprise and/or define a "front-end" architecture of a gaming platform such as a platform via which social network, causal, wagering, multiplayer, and/or online games may be played. The system 400 may be similar in configuration and/or functionality, for example, to the system 300 of FIG. 3 and/or one or more portions thereof. In some embodiments, the system 400 may comprise a user device 402, a plurality of networks (and/or environments and/or layers) 404*a-j* (e.g., the Internet 404*a*, a Distributed Denial-of-Service (DDoS) protection layer 404*b*, a primary transit provider layer 404*c*, a secondary transit provider layer 404*d*, a Pre-Production (PP) environment 404*e*, a live environment 404*f*, a LAN 404*g*, a backend environment 404*h*, a PP back-end layer 404*i*, and/or a live backend layer 404*j*), a plurality of routers 406*b-d*, a plurality of firewall devices 408*e-g*, 408*i-j*, a plurality of servers 410*e-f* (e.g., a PP server cluster 410*e* and/or a live server cluster 410*f*), a plurality of switching devices 422*a*, 422*e-f*, 422*i-j*, a Terminal Concentrator (TC) 424*f*, a plurality of "hydra" services 430*i-j* (e.g., a PP hydra service 430*i* and/or a live hydra service 430*j*), and/or a plurality of Power Distribution Unit (PDU) devices 452*e-f*.

According to some embodiments, any or all of the components 402, 404*a-j*, 406*b-d*, 408*e-g*, 408*i-j*, 410*e-f*, 422*a*, 422*e-f*, 422*i-j*, 424*f*, 430*i-j*, 452*e-f* of the system 400 may be similar in configuration and/or functionality to any similarly named and/or numbered components described herein. Fewer or more components 402, 404*a-j*, 406*b-d*, 408*e-g*, 408*i-j*, 410*e-f*, 422*a*, 422*e-f*, 422*i-j*, 424*f*, 430*i- j*, 452*e-f* (and/or portions thereof) and/or various configurations of the components 402, 404*a-j*, 406*b-d*, 408*e-g*, 408*i-j*, 410*e-f*, 422*a*, 422*e-f*, 422*i-j*, 424*f*, 430*i-j*, 452*e-f* may be included in the system 400 without deviating from the scope of embodiments described herein. While multiple instances of some components 404*a-j*, 406*b-d*, 408*e-g*, 408*i-j*, 410*e-f*, 422*a*, 422*e-f*, 422*i-j*, 430*i-j*, 452*e-f* are depicted and while single instances of other components 402, 424*f* are depicted, for example, any component 402, 404*a-j*, 406*b-d*, 408*e-g*, 408*i-j*, 410*e-f*, 422*a*, 422*e-f*, 422*i-j*, 424*f*, 430*i-j*, 452*e- f* depicted in the system 400 may comprise a single device, a combination of devices and/or components 402, 404*a-j*, 406*b-d*, 408*e-g*, 408*i-j*, 410*e-f*, 422*a*, 422*e-f*, 422*i-j*, 424*f*, 430*i-j*, 452*e-f*, and/or a plurality of devices, as is or becomes desirable and/or practicable. Similarly, in some embodiments, one or more of the various components 402, 404*a-j*, 406*b-d*, 408*e-g*, 408*i-j*, 410*e-f*, 422*a*, 422*e-f*, 422*i-j*, 424*f*, 430*i-j*, 452*e-f* may not be needed and/or desired in the system 400. In some embodiments, the system 400 may be configured and/or utilized to implement and/or facilitate the method 800 of FIG. 8, or one or more portions thereof In some embodiments, the user device 402 may be utilized to access one or more of the PP environment 404*e*, the live environment 404*f*, and/or the backend environment 404*h* via the Internet 404*a*. In some embodiments, the user device 402 may be utilized to access the backend environment 404*h* and/or the PP hydra service 430*i* via the PP backend layer 404*i*. A PP backend switch device 422*i* and/or a PP backend firewall device 408*i* may, for example, gate and/or control access to the back-end environment 404*h* and/or the PP hydra service 430*i*, via the PP backend layer 404*i*. In some embodiments, the user device 402 may be utilized to access the backend environment 404*h* and/or the live hydra service 430*j* via the live backend layer 404*j*. A live backend switch device 422*j* and/or a live backend firewall device 408*j* may, for example, gate and/or control access to the backend environment 404*h* and/or the live hydra service 430*j*, via the live backend layer 404*j*.

According to some embodiments, any communications (e.g., requests, calls, and/or messages) from the user device 402 may be passed through the DDoS protection layer 404*b*. The DDoS protection layer 404*b* may, for example, monitor and/or facilitate protection against various forms of cyber attacks including, but not limited to, DDoS attacks. In some embodiments, the DDoS protection layer 404*b* may comprise and/or be in communication with a plurality of DDoS router devices 406*b*-1, 406*b*-2, 406*b*-3, 406*b*-4 that may be utilized to route and/or direct incoming communications (e.g., from the user device 402) to appropriate portions of the system 400.

In some embodiments, the DDoS protection layer 404*b* and/or a first DDoS router device 406*b*-1 may route communications from the user device 402 through and/or via a first switch device 422*a*-1 and/or to, through, and/or via a first primary transit provider router device 406*c*-1. In some embodiments, the first switch device 422*a*-1 may comprise a device utilized for security switching such as may implement communications in accordance with the Generic Routing Encapsulation (GRE) communications tunneling protocol described in RFC 2784 "Generic Routing Encapsulation (GRE)" published by the Network Working Group (NWG) in March, 2000. The first primary transit provider router device 406*c*-1 may, for example, provide access to the PP environment 404*e* and/or the PP server cluster 410*e* thereof, such as via one or more PP firewall devices 408*e*-1, 408*e*-2 and/or one or more PP switch devices 422*e*-1, 422*e*-2. According to some embodiments, the PP switch devices 422*e*-1, 422*e*-2 may comprise content switching devices that process and route data (e.g., in the data link layer) based on data content. In some embodiments, the first primary transit provider router device 406*c*-1 may direct communications to, through, and/or via a PP LAN switch device 422*e*-3 that provides and/or facilitates access to the LAN 404*g*. The LAN 404*g* may, for example, provide private access to and/or between the PP environment 404*e*, the live environment 404*f*, and/or the backend environment 404*h*. In some embodiments, the first primary transit provider router device

406*c*-1 and/or the PP LAN switch device 422*e*-3 may direct communications to, through, and/or via a LAN firewall device 408*g* that provides direct access to either or both of the PP server cluster 410*e* and the live server cluster 410*f*.

According to some embodiments, the DDoS protection layer 404*b* and/or a second DDoS router device 406*b*-2 may route communications from the user device 402 through and/or via a second switch device 422*a*-2 and/or to, through, and/or via a first secondary transit provider router device 406*d*-1. In some embodiments, the second switch device 422*a*-2 may comprise a device utilized for security switching such as may implement communications in accordance with the GRE communications tunneling protocol described in RFC 2784 "Generic Routing Encapsulation (GRE)" published by the Network Working Group (NWG) in March, 2000. The first secondary transit provider router device 406*d*-1 may, for example, provide access to the live environment 404*f* and/or the live server cluster 410*f* thereof, such as via one or more live firewall devices 408*f*-1, 408*f*-2 and/or one or more live switch devices 422*f*-1, 422*f*-2. According to some embodiments, the live switch devices 422*f*-1, 422*f*-2 may comprise content switching devices that process and route data (e.g., in the data link layer) based on data content. In some embodiments, the first secondary transit provider router device 406*d*-1 may direct communications to, through, and/or via a live LAN switch device 422*f*-3 that provides and/or facilitates access to the LAN 404*g*. In some embodiments, the first secondary transit provider router device 406*d*-1 and/or the live LAN switch device 422*f*-3 may direct communications to, through, and/or via the LAN firewall device 408*g* that provides direct access to either or both of the PP server cluster 410*e* and the live server cluster 410*f*.

In some embodiments, the DDoS protection layer 404*b* and/or one or more of a third DDoS router device 406*b*-3 and/or a fourth DDoS router device 406*b*-4 may route communications from the user device 402 through and/or via one or more of the primary transit provider layer 404*c* and/or the secondary transit provider layer 404*d*. In some embodiments, a transit provider switch device 422*a*-3 may direct, swap, route, and/or manage communications between the primary transit provider layer 404*c* and the secondary transit provider layer 404*d*. According to some embodiments, the transit provider switch device 422*a*-3 may comprise a switching device that operates in accordance with an Exterior Border Gateway Protocol (EBGP)—e.g., the transit provider switch device 422*a*-3 may comprise one or more edge or border routers. In some embodiments, the first primary transit provider router device 406*c*-1, the first secondary transit provider router device 406*d*-1, a second primary transit provider router device 406*c*-2, and/or a second secondary transit provider router device 406*d*-2 may be utilized to route and/or direct communications between (i) the primary transit provider layer 404*c* and/or the secondary transit provider layer 404*d* and (ii) the PP environment 404*e* and/or the live environment 404*f*.

According to some embodiments, the PP server cluster 410*e* and/or the PP environment 404*e* may comprise various hardware, software, and/or firmware that permits a user (e.g., of the user device 402) to program, edit, manage, and/or otherwise interface with PP game elements and/or interfaces (e.g., for development and/or testing purposes). In some embodiments, the PDU devices 452*e*-1, 452*e*-2 may generally provide power distribution, supply, management, backup, and/or conditioning services (e.g., to the PP server cluster 410*e*) as is or becomes desired. According to some embodiments, additional switch devices 422*e*-4, 422*e*-5 may be utilized to distribute, balance, manage and/or control communications to, from, and/or within the PP server cluster 410*e*.

Figure 9A:
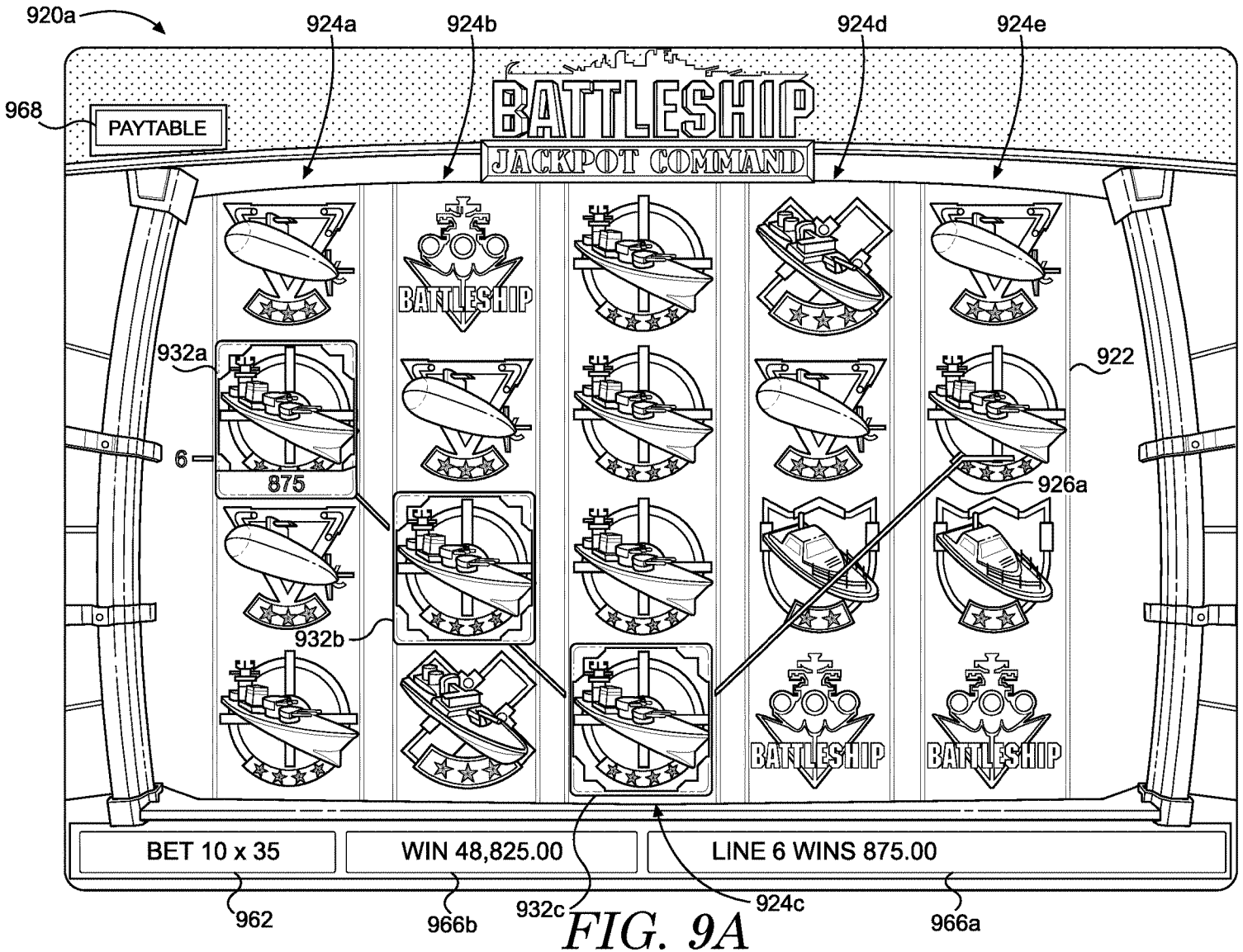
FIG. 9A, FIG. 9B, FIG. 9C, and FIG. 9D are block diagrams of an example game interface according to some embodiments.
Figure 9B:
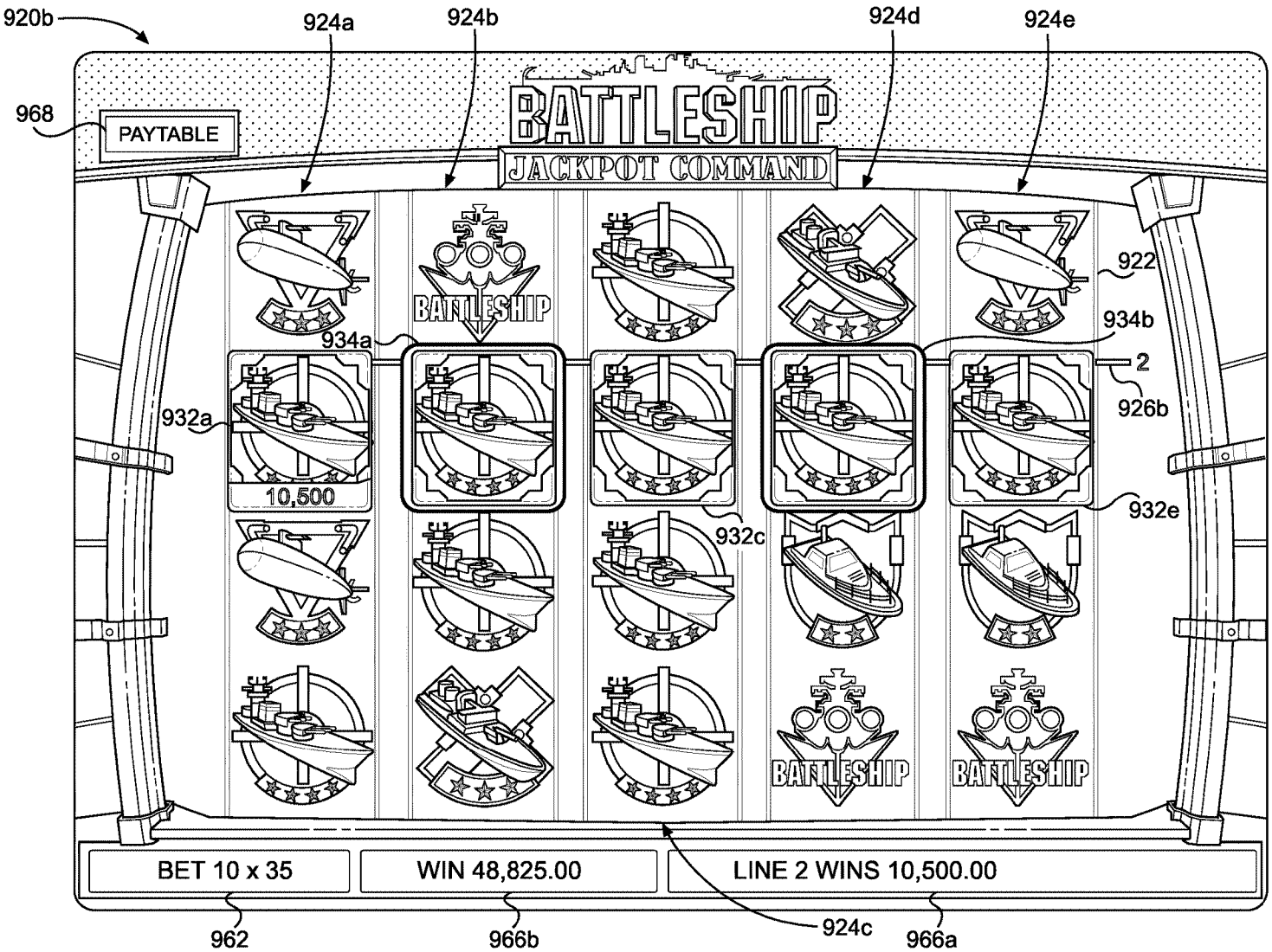
Figure 9C:
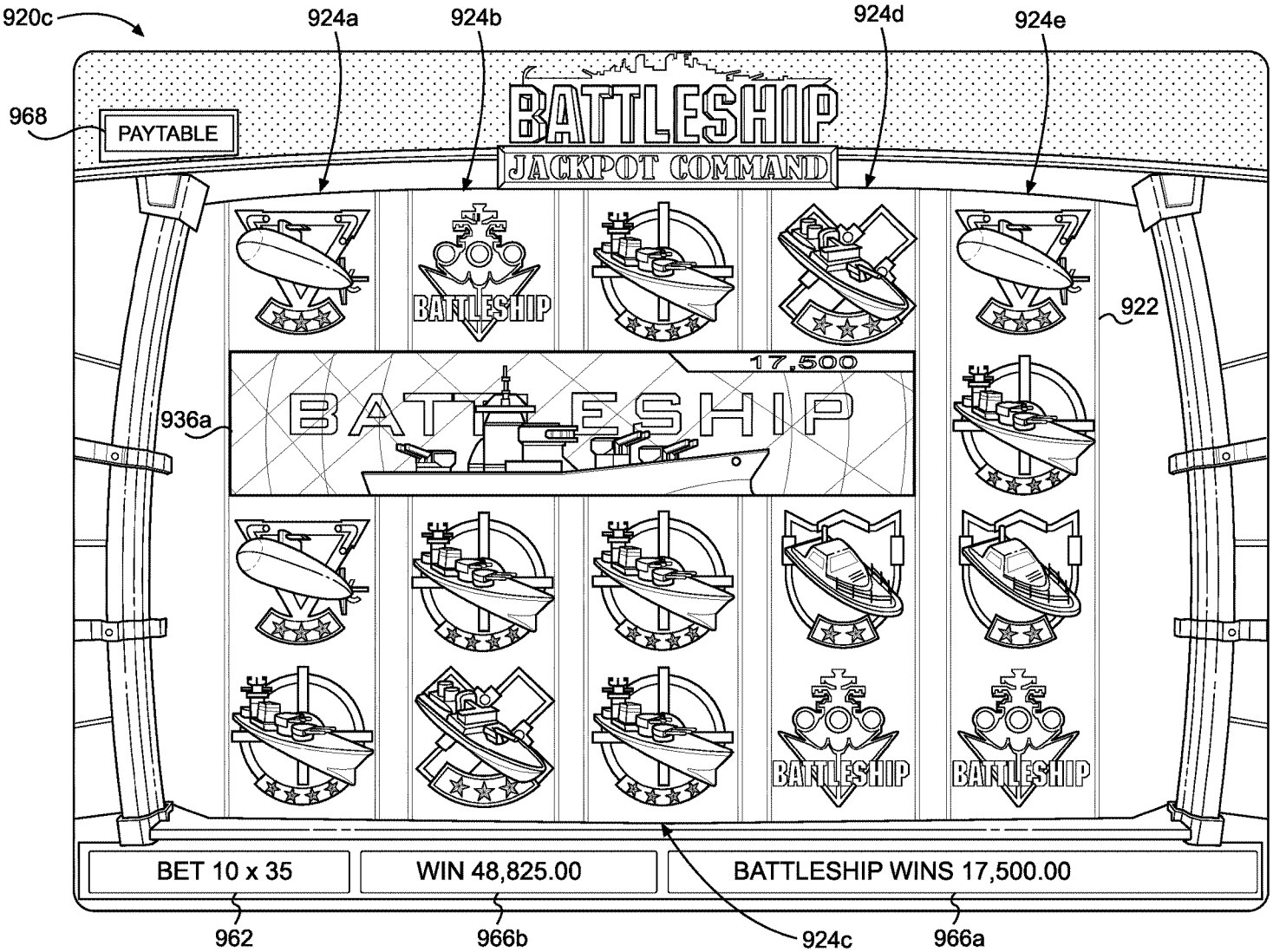
Figure 9D:
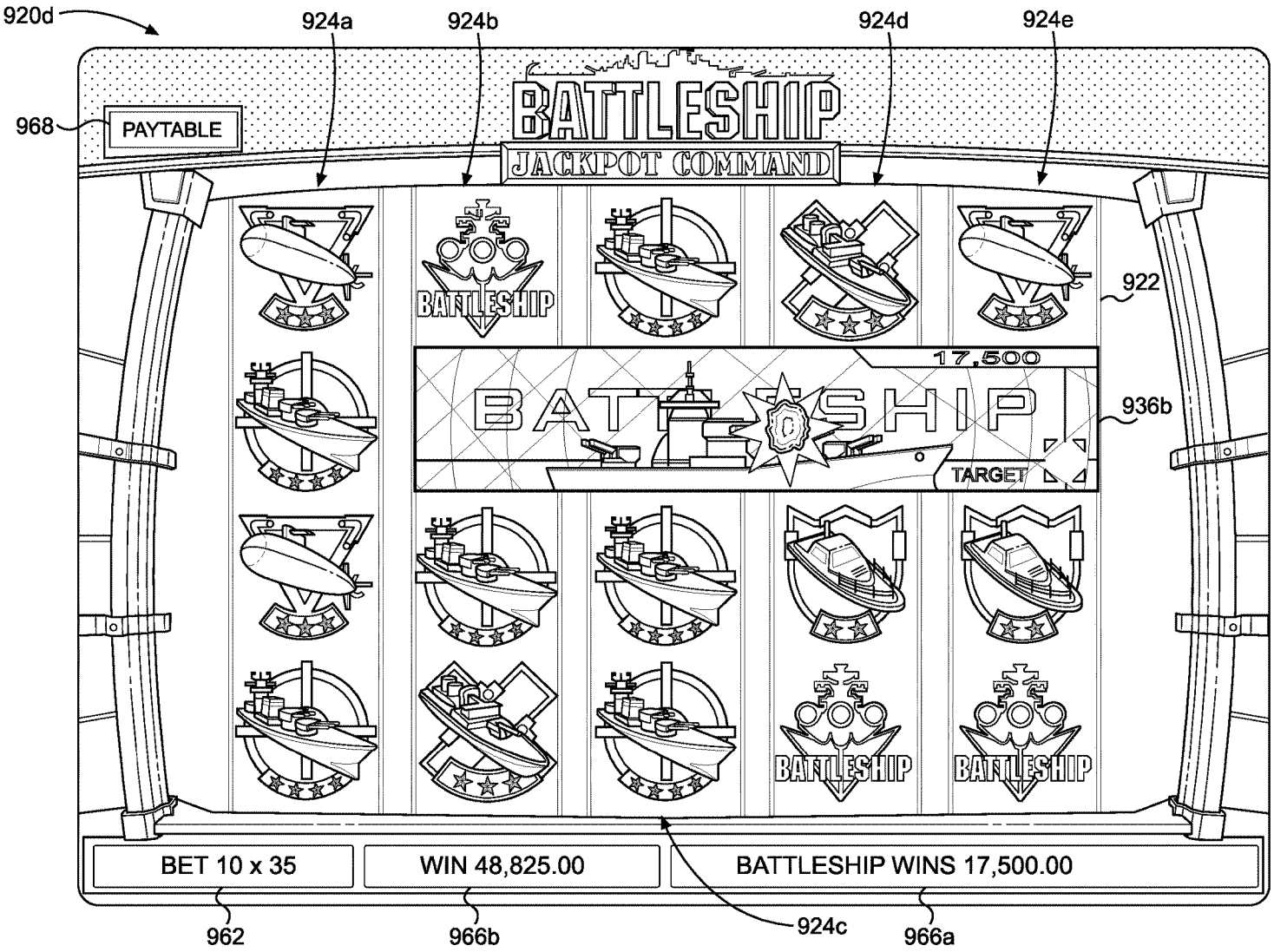
Figure 10A:
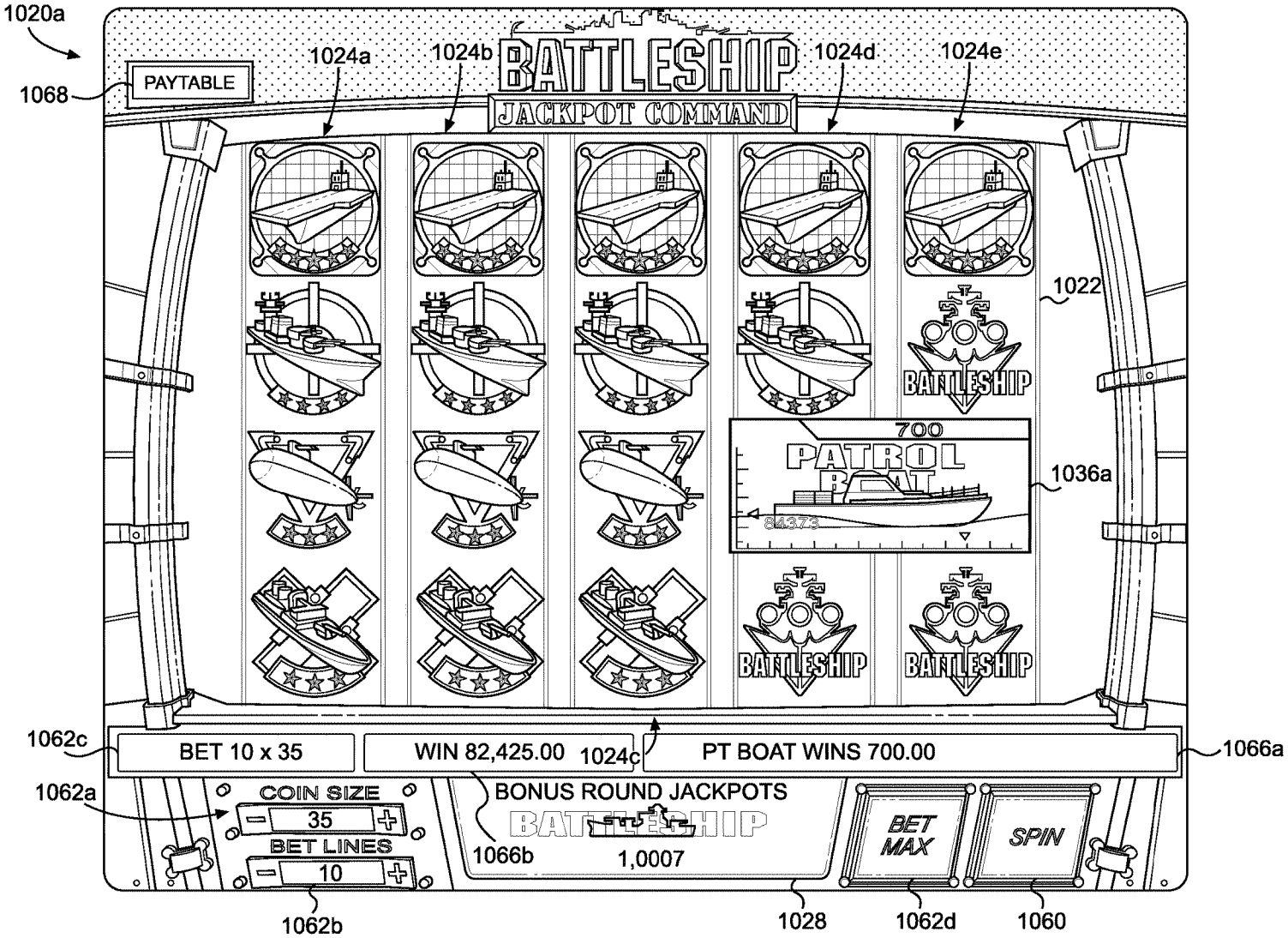
FIG. 10A, FIG. 10B, FIG. 10C, FIG. 10D, and FIG. 10E are block diagrams of an example game interface according to some embodiments.
Figure 10B:
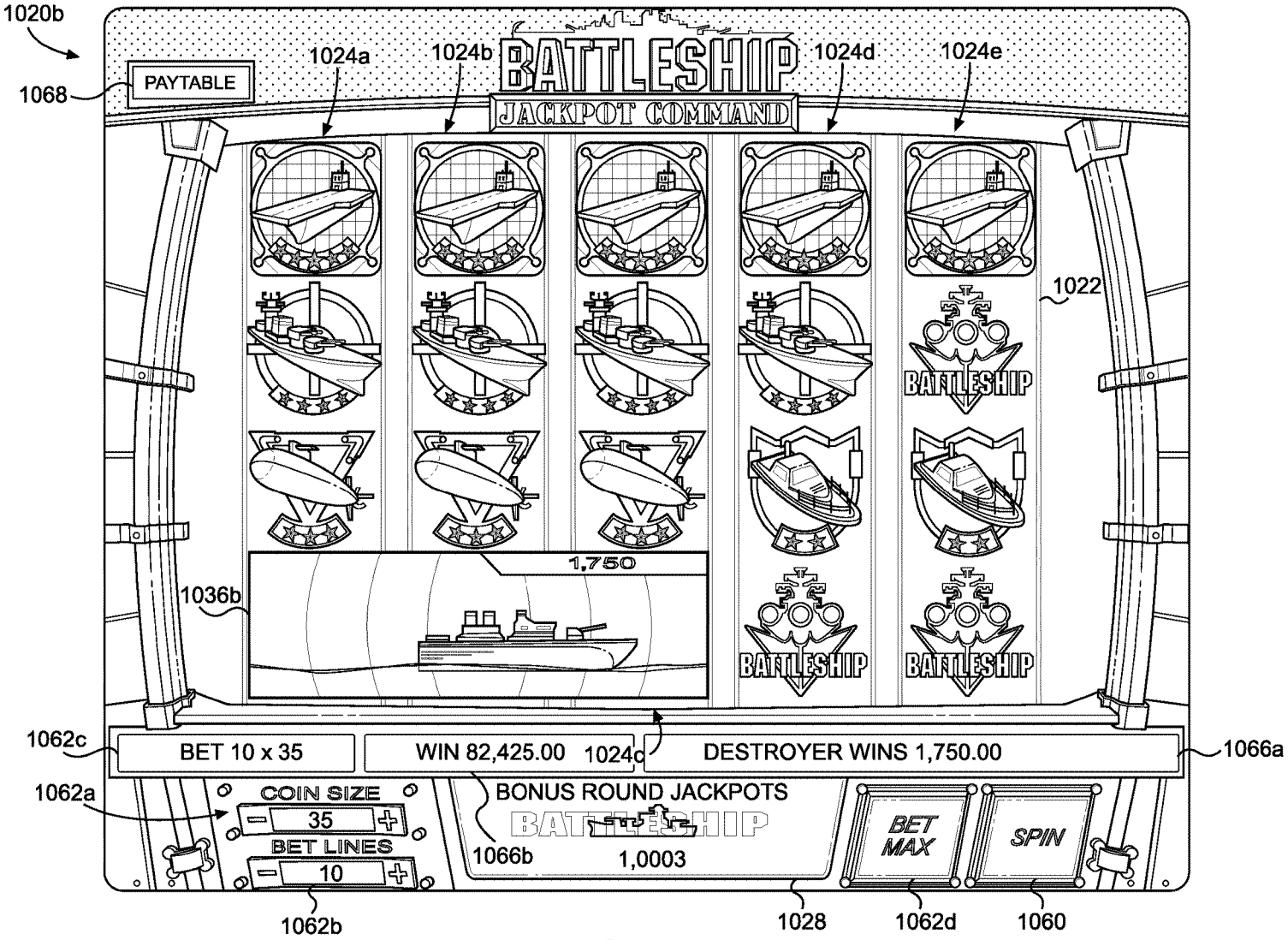
Figure 10C:
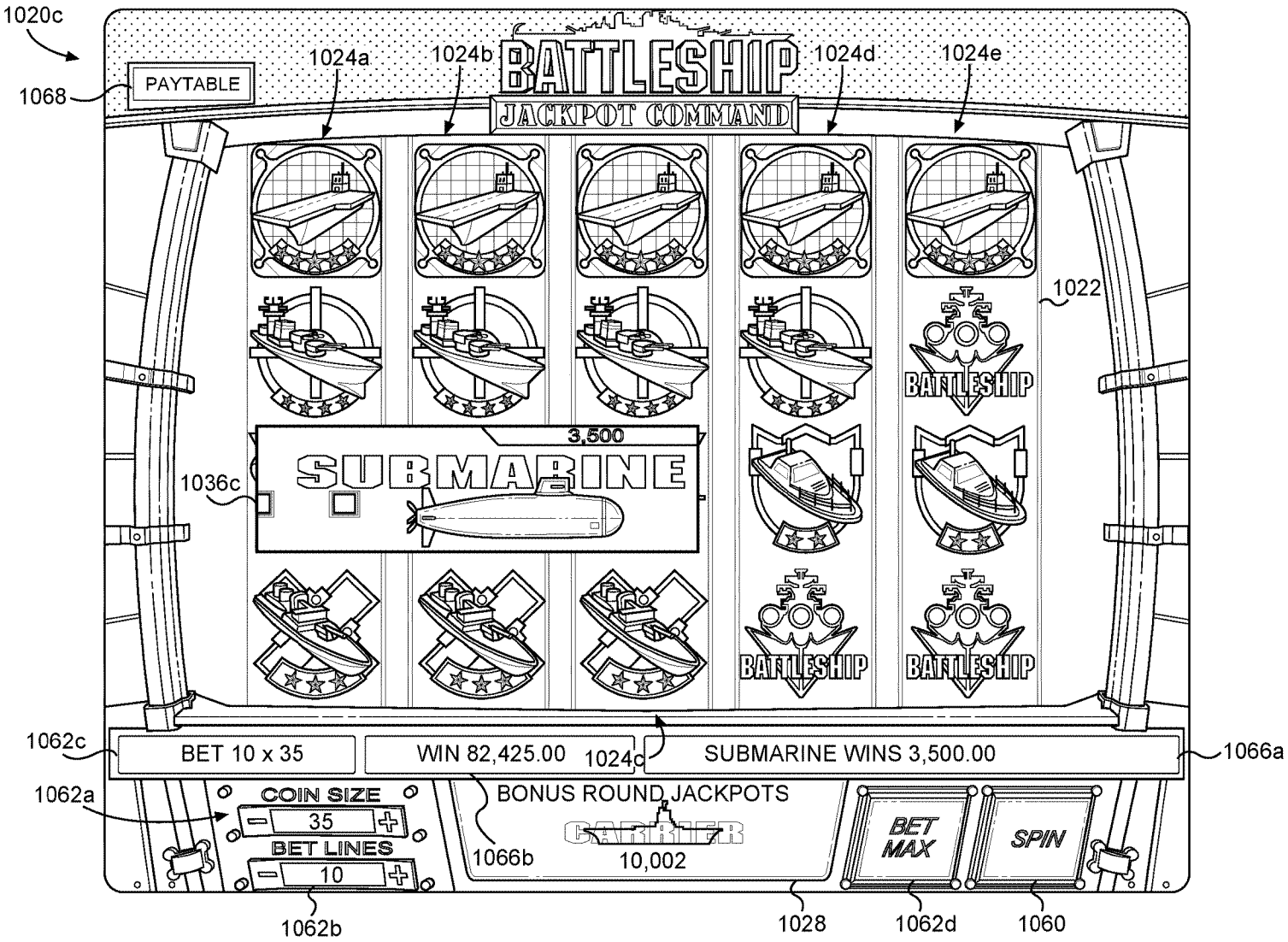
Figure 10D:
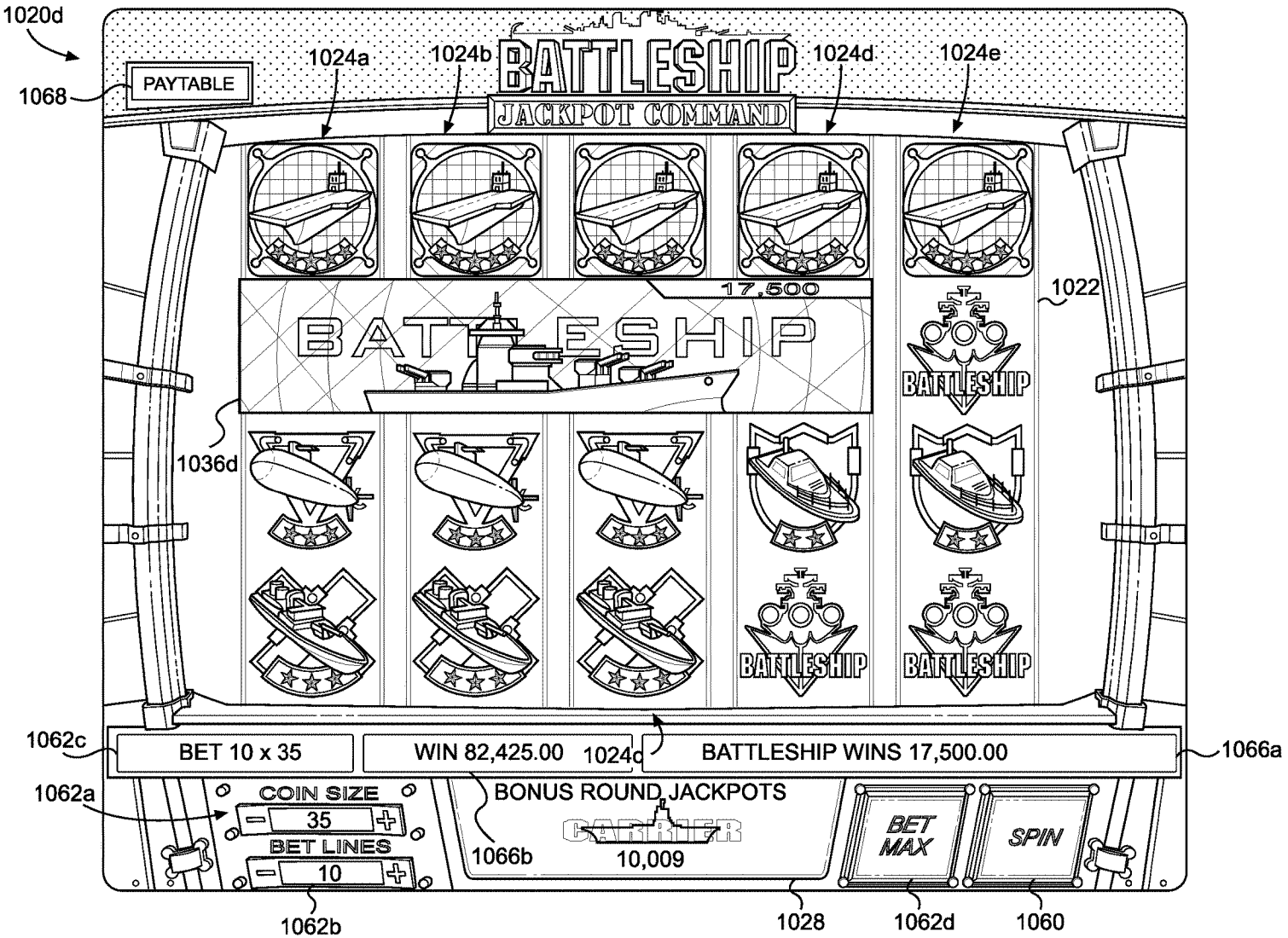
Figure 10E:
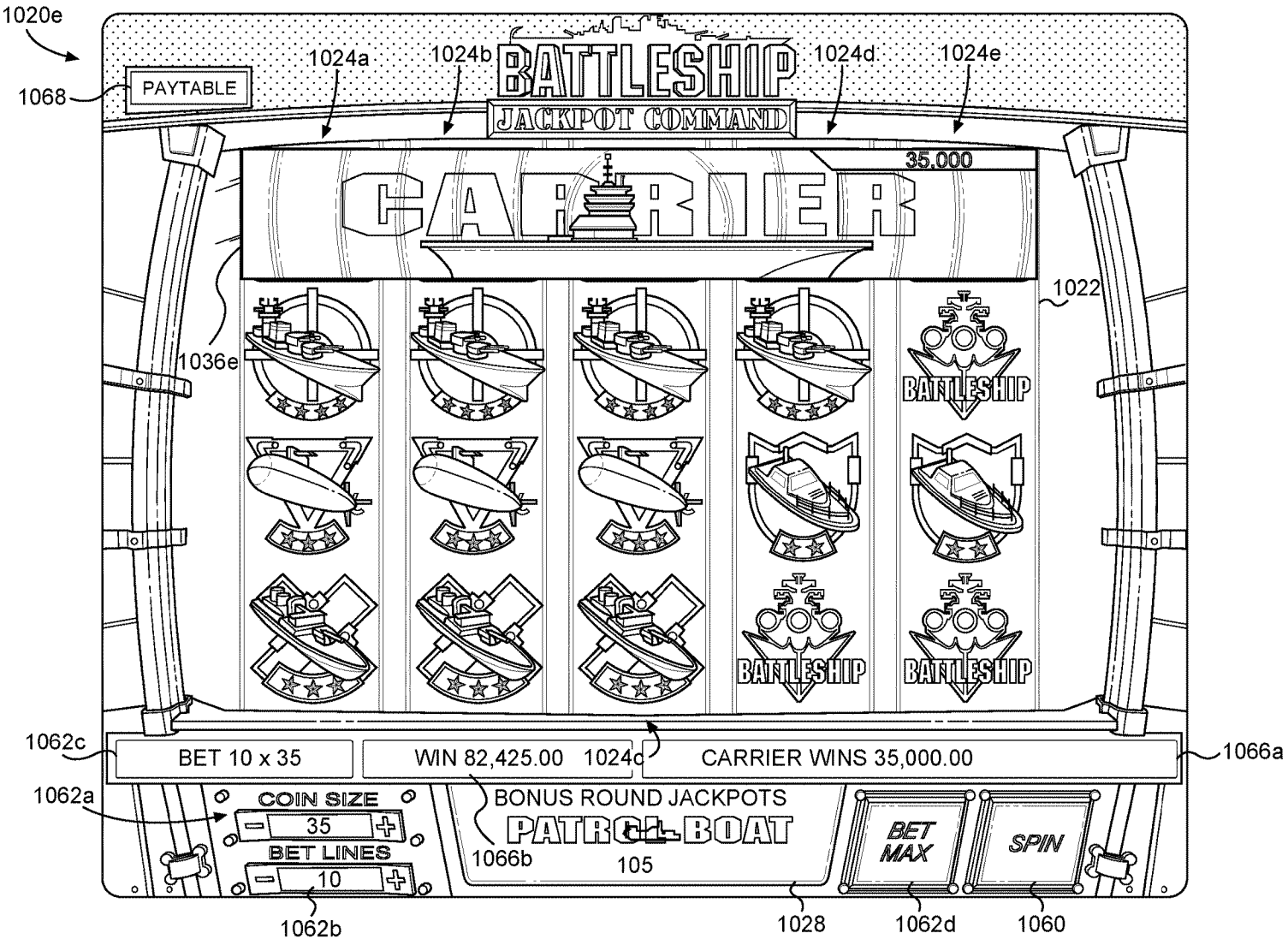

In some embodiments, the live server cluster 410*f* and/or the live environment 404*f* may comprise various hardware, software, and/or firmware that permits a user (e.g., of the user device 402) to program, edit, manage, and/or otherwise interface with live game elements and/or interfaces (e.g., for troubleshooting, corrective, and/or live environment management purposes; e.g., e.g., the interfaces 620, 720, 920*a*-*d*, 1020*a*-*e* of FIG. 6, FIG. 7, FIG. 9A, FIG. 9B, FIG. 9C, FIG. 9D, FIG. 10A, FIG. 10B, FIG. 10C, FIG. 10D, and/or FIG. 10E herein). In some embodiments, the PDU devices 452*f*-1, 452*f*-2 may generally provide power distribution, supply, management, backup, and/or conditioning services (e.g., to the live server cluster 410*f*) as is or becomes desired. According to some embodiments, additional switch devices 422*f*-4, 422*f*-5 may be utilized to distribute, balance, manage and/or control communications to, from, and/or within the live server cluster 410*f*. In some embodiments, the TC device 424*f* may be utilized to manage communications from a variety of data sources such as by providing communication capability between various communications channels (not separately depicted in FIG. 4).

Figure 5:
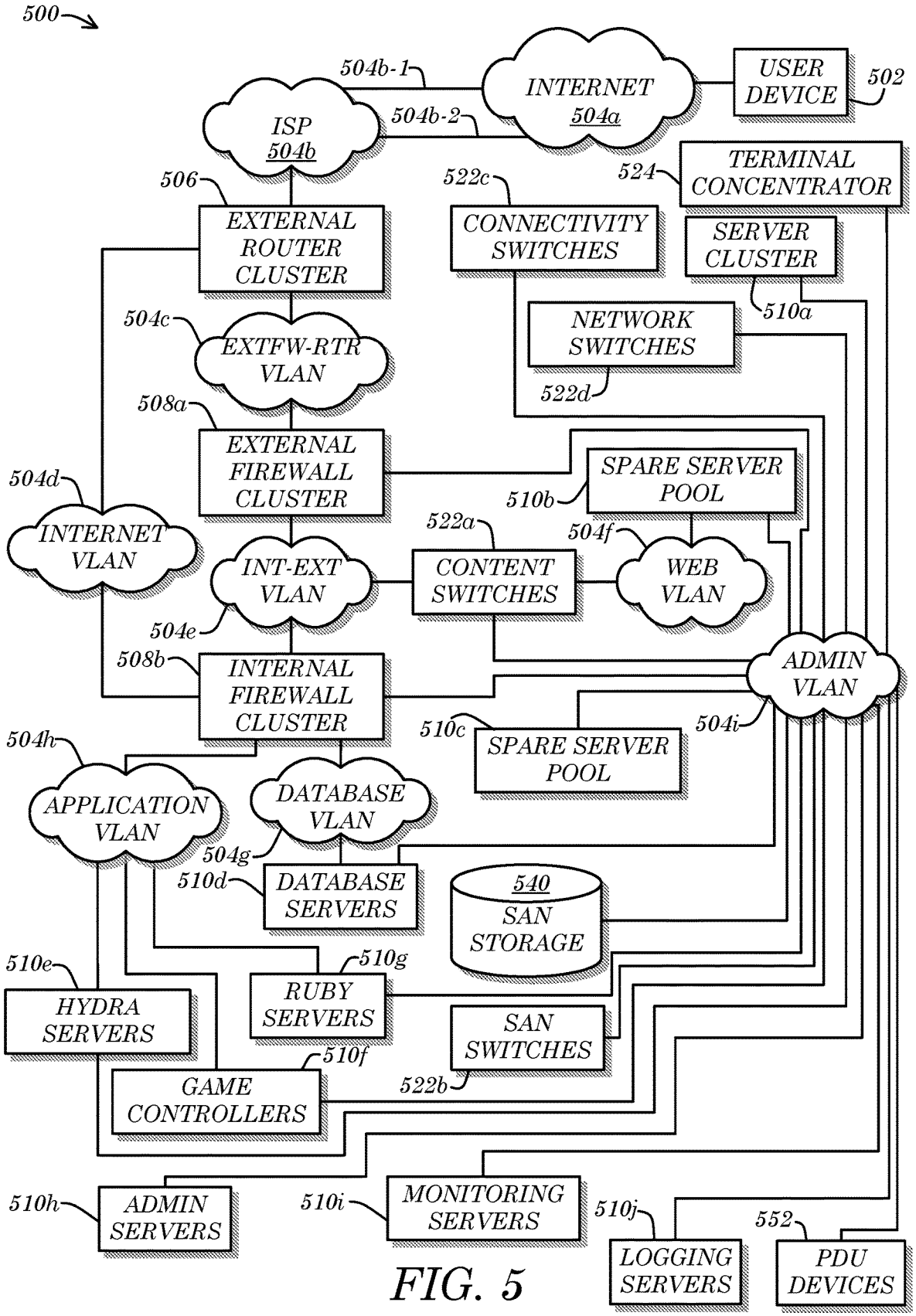
FIG. 5 is a block diagram of a system according to some embodiments.

Turning to FIG. 5, a block diagram of a system 500 according to some embodiments is shown. In some embodiments, the system 500 may comprise and/or define a "backend" architecture of a gaming platform such as a platform via which social network, casual, wagering, multiplayer, and/or online games may be played. The system 500 may be utilized in conjunction with the systems 300, 400 if FIG. 3 and/or FIG. 4 herein, for example, and/or may be similar in configuration and/or functionality to the backend environment 404*h* of the system 400 of FIG. 4. In some embodiments, the system 500 may comprise a user device 502, a plurality of networks (and/or environments and/or layers) 504*a*-*i* (e.g., the Internet 504*a*, an ISP 504*b*, an External Firewall-Router (EXTFW-RTR) Virtual LAN (VLAN) 504*c*, an Internet VLAN 504*d*, an Internal-External (INT-EXT) VLAN 504*e*, a web VLAN 504*f*, a database VLAN 504*g*, an application VLAN 504*h*, and/or an administrator VLAN 504*i*), an external router cluster 506, a plurality of firewall clusters 508*a*-*b* (e.g., an external firewall cluster 508*a* and/or an internal firewall cluster 508*b*), a plurality of servers 510*a*-*j* (e.g., a server cluster 510*a*, a first spare server pool 510*b*, a second spare server pool 510*c*, database servers 510*d*, "hydra" servers 510*e*, game controllers 510*f*, ruby servers 510*g*, admin servers 510*h*, monitoring servers 510*i*, and/or logging servers 510*j*), a plurality of switches 522*a*-*d* (e.g., content switches 522*a*, Storage Area Network (SAN) switches 522*b*, connectivity switches 522*c*, and/or network switches 522*d*), a TC device 524, a SAN storage device 540, and/or one or more PDU devices 552.

According to some embodiments, any or all of the components 502, 504*a*-*l*, 506, 508*a*-*b*, 510*a*-*j*, 522*a*-*d*, 524, 540, 552 of the system 500 may be similar in configuration and/or functionality to any similarly named and/or numbered components described herein. Fewer or more components 502, 504*a*-*l*, 506, 508*a*-*b*, 510*a*-*j*, 522*a*-*d*, 524, 540, 552 (and/or portions thereof) and/or various configurations of the components 502, 504*a*-*l*, 506, 508*a*-*b*, 510*a*-*j*, 522*a*-*d*, 524, 540, 552 may be included in the system 500 without deviating from the scope of embodiments described herein. While multiple instances of some components 504*a*-*l*, 508*a*-*b*, 510*a*-*j*, 522*a*-*d* are depicted and while single instances of other components 502, 506, 524, 540, 552 are depicted, for example, any component 502, 504*a*-*l*, 506, 508*a*-*b*, 510*a*-*j*, 522*a-d*, 524, 540, 552 depicted in the system 500 may comprise a single device, a combination of devices and/or components 502, 504*a-l*, 506, 508*a-b*, 510*a-j*, 522*a-d*, 524, 540, 552, and/or a plurality of devices, as is or becomes desirable and/or practicable. Similarly, in some embodiments, one or more of the various components 502, 504*a-l*, 506, 508*a-b*, 510*a-j*, 522*a-d*, 524, 540, 552 may not be needed and/or desired in the system 500. In some embodiments, the system 500 may be configured and/or utilized to implement and/or facilitate the method 800 of FIG. 8, or one or more portions thereof In some embodiments, the user device 502 may be utilized to access and/or interface with one or more of the servers 510*a-j* via the Internet 504*a*. In some embodiments, the Internet 502*a* may be linked to the ISP 504*b* via multiple (e.g., redundant) connectivity paths 504*b*-1, 504*b*-2 (e.g., for load balancing, security, and/or failure recovery). According to some embodiments, the ISP 504*b* may be in communication with (and/or comprise) the external router cluster 506. The external router cluster 506 may route certain requests, calls, and/or transmissions (and/or users—e.g., based on credentials and/or other information) through the EXTFW-RTR VLAN 504*c* and/or through the external firewall cluster 508*a*, for example, and/or may route certain requests, calls, and/or transmissions (and/or users—e.g., based on credentials and/or other information) through the Internet VLAN 504*d* and/or through the internal firewall cluster 508*b*.

In the case that a user (not shown) of the user device 502 comprises an online game player, consumer, and/or other member of the public, for example, the external router cluster 506 may direct communications through the EXTFW-RTR VLAN 504*c* and/or through the external firewall cluster 508*a*. In the case that the user of the user device 502 comprises a programmer, tester, employee, and/or other agent of an entity that operates the system 500 (e.g., a game provider), for example, the external router cluster 506 may direct communications through the Internet VLAN 504*d* and/or through the internal firewall cluster 508*b*. In some embodiments, access via either or both of the external firewall cluster 508*a* and/or the internal firewall cluster 508*b* may permit the user device 502 to communicate via the INT-EXT VLAN 504*e*. The INT-EXT VLAN 504*e* may, for example, provide access to the content switches 522*a* which may, in some embodiments, serve content from any or all of the servers 510*a-j* to the user device 502, as is or becomes appropriate or desired. In some embodiments, the content switches 522*a* may communicate with the first spare server pool 510*b* via the web LAN 504*f*.

According to some embodiments, private and/or other specialized access to the system 500 via the internal firewall cluster 508*b* may permit the user device 502 to communicate via one or more of the database VLAN 504*g*, the application VLAN 504*h*, and/or the admin VLAN 504*i*. The database VLAN 504*g* may be utilized, for example, to access and/or communicate with the database servers 510*d*. In some embodiments, the application VLAN 504*h* may be utilized to access and/or communicate with any or all of the hydra servers 510*e*, the game controllers 510*f*, and/or the ruby servers 510*g*.

The admin VLAN 504*i* may allow, promote, conduct, facilitate, and/or manage a wide variety of communications within the system 500. The admin VLAN 504*i* may, for example, communicatively connect and/or couple any or all of the firewalls 508*a-b*, the servers 510*a-j*, the switches 522*a-d*, the TC device 524, the SAN storage 540, and/or the PDU devices 552. The user device 502 may be utilized, in conjunction with the admin servers 510*h* and/or via the admin VLAN 504*i* for example, to define, edit, adjust, manage, and/or otherwise access settings (and/or data) of the firewalls 508*a-b*, any or all of the switches 522*a-d*, the TC device 524, and/or the PDU devices 552. In some embodiments, the user device 502 (and/or the admin servers 510*h*) may be utilized to manage and/or access content, rules, settings, and/or performance characteristics or preferences for any or all of the servers 510*a-j*.

In some embodiments, the server cluster 510*a* may comprise one or more servers and/or other electronic controller devices (e.g., blade servers) configured to provide online gaming data (e.g., interfaces such as the interfaces 620, 720, 920*a-d*, 1020*a-e* of FIG. 6, FIG. 7, FIG. 9A, FIG. 9B, FIG. 9C, FIG. 9D, FIG. 10A, FIG. 10B, FIG. 10C, FIG. 10D, and/or FIG. 10E herein, and/or outcomes or results) to the user device 502. According to some embodiments, the first spare server pool 510*b* and/or the second spare server pool 510*c* may comprise one or more server and/or other electronic controller devices configured to supplement and/or replace the server cluster 510*a* as needed and/or desired (e.g., to manage load and/or error recovery situations). In some embodiments, the database servers 510*c* may provide and/or manage access to stored data such as data stored in and/or by the SAN storage device 540. In some embodiments, the hydra servers 510*e* and/or the game controllers 510*f* may provide online game information such as interfaces, outcomes, results, graphics, sounds, and/or other media to the user device 502 (e.g., via the application VLAN 504*h*). In some embodiments, the ruby servers 510*g* may comprise one or more processing devices configured to provide access to one or more programming languages (e.g., "Ruby") and/or Application Programming Interface (API) mechanisms via which the servers 510*a-j* and/or other portions of the system 500 may be configured to operate (e.g., in accordance with specially and/or pre-programmed instructions written in the programming language and/or developed by the API provided by the ruby servers 510*g*). According to some embodiments, the admin servers 510*h*, the monitoring servers 510*i*, and/or the logging servers 510*j* may be utilized and/or configured to provide administrative, parameter and/or metric monitoring and/or reporting, and/or data logging and/or audit services, respectively.

Figure 6:
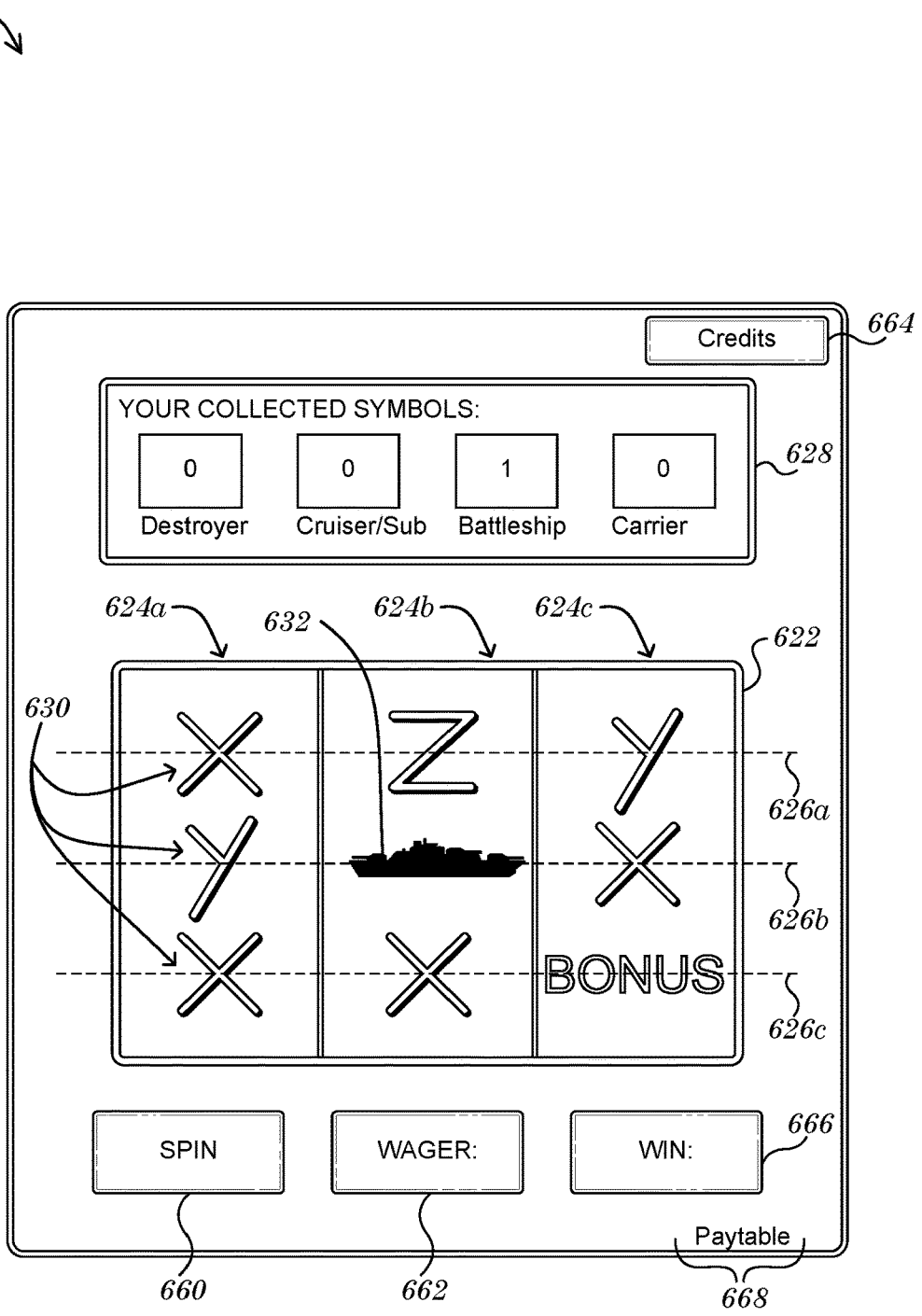
FIG. 6 is a block diagram of an example game interface according to some embodiments.

Referring now to FIG. 6, a block diagram of an example game interface 620 according to some embodiments is shown. In some embodiments, the example game interface 620 may be facilitated, implemented, and/or effectuated by one or more of the systems 100, 200, 300, 400, 500 of FIG. 1, FIG. 2, FIG. 3, FIG. 4, and/or FIG. 5, and/or one or more components, portions, and/or combinations thereof. In some embodiments, the example interface 620 may be utilized in conjunction with and/or as a result of an implementation of the method 800 of FIG. 8, or one or more portions thereof. According to some embodiments, the example game interface 620 may comprise a primary outcome area 622 (e.g., in the case of the depicted slot-style game, comprising a plurality of slot reels 624*a-c* and/or a plurality of paylines 626*a-c*) configured to output indications descriptive of and/or associated with a primary game and/or a secondary outcome area 628 configured to output indications descriptive of and/or associated with a secondary (e.g., bonus) game. The primary outcome area 622 may, for example, output indications of a plurality of game symbols 630 (e.g., the depicted "X", "Y", "Z", "BONUS", and ship symbols) and/or the secondary outcome area 628 may indicate a number of occurrences that have been realized (e.g., over a plurality of primary game turns, spins, etc.) with respect to a subset or portion of the game symbols 630. For ease of reference with respect to different depicted game symbols 630, each symbol may be identified herein (uniquely for any particular primary outcome area 622) by reference to a combination of the letter designations of the corresponding reel 624*a-c* and payline 626*a-c*. The "Z" game symbol 630 may be identified, for example, as "b-a"—i.e., occurring on the second reel 624*b* at the first position and/or payline 626*a* thereof and/or associated therewith. According to some embodiments, the example game interface 620 may comprise a spin area 660, a wager area 662, a credit area 664, a win area 666, and/or a paytable area 668.

In some embodiments, the primary outcome area 622 and/or the secondary outcome area 628 may comprise a plurality of areas for outputting (and/or configured to output) various information to a player and/or for enabling (and/or configured to enable) certain functionality or inputs from a player. For example, a the credit area 664 may indicate to a player a number of credits, value and/or currency (equivalents, real currency, virtual currency, and/or otherwise) available to the player for making wagers and/or otherwise participating in (e.g., non-wagering credits, spins, turns, etc.) a primary game. The secondary outcome area 628 may output to the player a number of each type of bonus round and/or other secondary game symbols collected by the player thus far in a current session of the primary game (e.g., since the initiation of the primary game by the player or since the end of a previous bonus round participated in by the player, since the bonus round symbols may be reset after each bonus round). In some embodiments, the primary outcome area 622 may output to the player outcomes of the primary game (e.g., a player may win a payout if a winning combination of regular game symbols 630 appears, at the resolution of the game session and/or instance or stopping of the reels 624*a-c* for a current spin in a reeled slot machine-type game, along one or more of the paylines 626*a-c*). In accordance with some embodiments, any bonus round symbols (e.g., game symbols 630 associated with bonus and/or secondary game play and/or initiation) won by a player as a result of a game session and/or instance of the primary game may be first output in the primary outcome area 622 of the example game interface 620 (e.g., each bonus round symbol overlaid onto a respective regular symbol in a given symbol position; e.g., the "BONUS" game symbol 630 at "c-c", as depicted) and then, after initial resolution of the reels 624*a-c* or symbol positions for the primary game, moved to the secondary outcome area 628.

In some embodiments, in a primary game the regular game symbols 630 are output on the reels 624*a-c* (real and/or virtual) in the primary outcome area 622 and any bonus round symbols won by the player as a result of a spin initially may cover up or obscure the regular game symbols 630 when the reels first stop spinning. The bonus round symbols may then be animated or otherwise be shown to move from covering the regular game symbols 630 (thus revealing the regular game symbols 630 or un-obscuring these) and moved to another area (e.g., secondary outcome area 628) of the example game interface 620 (e.g., an area for outputting to the player the type and number of bonus round symbols collected thus far and usable in the next bonus round). Co-pending patent application Ser. No. 13/543,458 describes various methodologies for how symbols for a first aspect of a game may be overlaid or otherwise output along with symbols for a second aspect of the game and then moved to a different area of a game interface (such concept and descriptions of which are hereby incorporated by reference herein).

The example game interface 620, in some embodiments, may include the spin area 660 (e.g., for allowing a player to initiate a spin or game instance of the primary game), the wager area 662 (e.g., for allowing a player to indicate a value of a wager for a current spin and/or outputting to the player the value of the wager being used for the current game instance), the win area 666 (e.g., for indicating to a player a value of a payout or other prize won as a result of the current game instance), and/or the paytable area 668 (e.g., for allowing a player to access a paytable being utilized for the game). Other areas and/or information may also or alternatively be output to a player and/or some of this information may be omitted.

According to some embodiments, the example game interface 620 and/or the primary outcome area 622 may comprise a connecting symbol 632. The connecting symbol 632 may, for example, comprise a scatter symbol and/or a particular type of symbol that causes the primary game and/or bonus or secondary game to perform in a certain manner. In some embodiments, associations between one or more connecting symbols 632, such as relative orientations and/or positions there between, may cause one or more payouts, secondary payouts, bonus payouts, and/or the provision of one or more other benefits to a player.

Figure 7A:
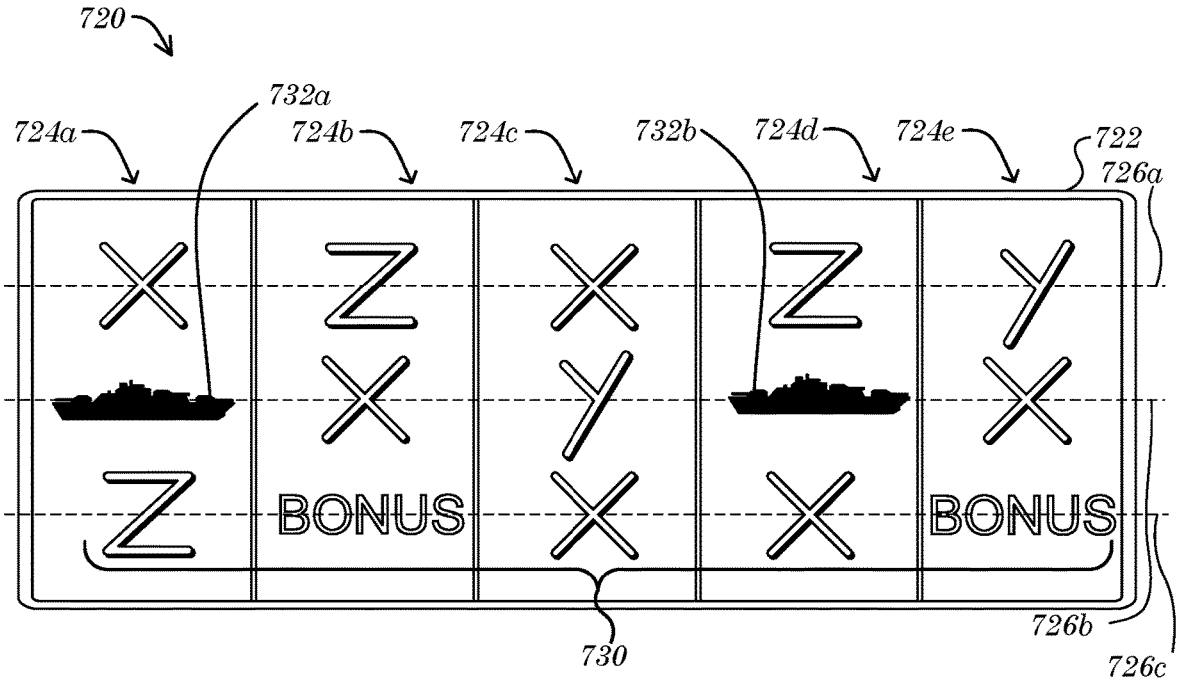
FIG. 7A and FIG. 7B are block diagrams of an example game interface according to some embodiments.
Figure 7B:
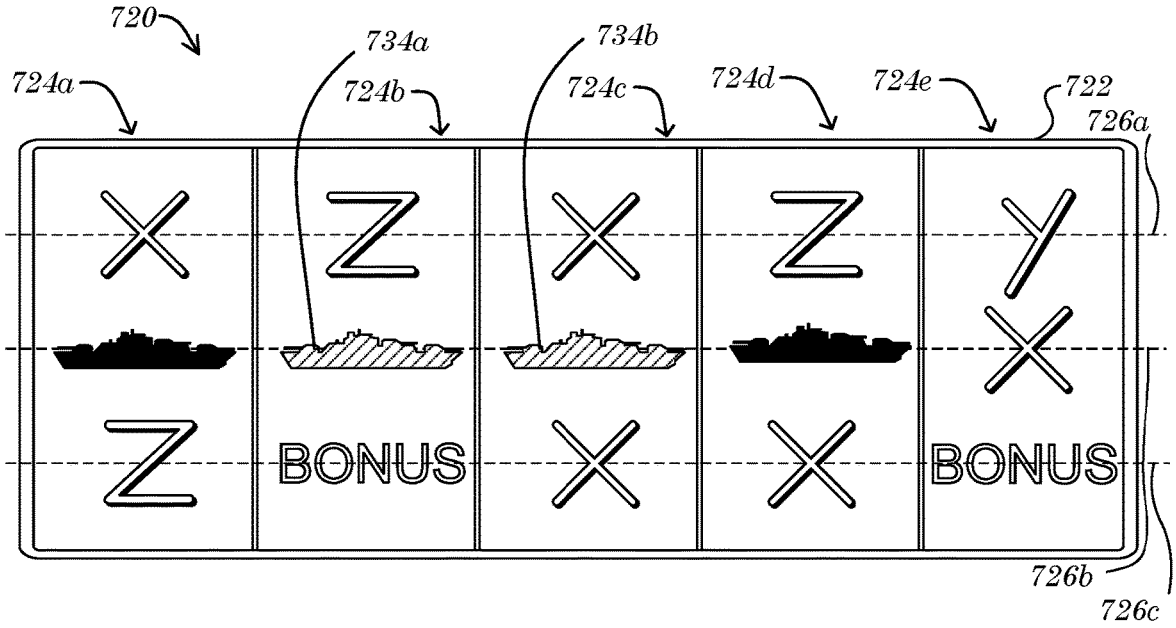

Referring to FIG. 7A and FIG. 7B, for example, a block diagram of an example game interface 720 according to some embodiments is shown. In some embodiments, the example game interface 720 may be facilitated, implemented, and/or effectuated by one or more of the systems 100, 200, 300, 400, 500 of FIG. 1, FIG. 2, FIG. 3, FIG. 4, and/or FIG. 5 and/or the example game interface 620 of FIG. 6, and/or one or more components, portions, and/or combinations thereof.

In some embodiments, and with initial reference to FIG. 7A, the example game interface 720 may comprise a primary outcome area 722 (e.g., in the case of the depicted slot-style game, comprising a plurality of slot reels 724*a-e* and/or a plurality of paylines 726*a-c*) including a plurality of game symbols 730, e.g., disposed along one or more of the paylines 726*a-c*. In some cases, one or more of the game symbols 730 may comprise a scatter symbol such as one or more of the "BONUS" symbols 730 depicted at "b-c" and/or "e-c" in FIG. 7A along a third payline 726*c*. In some embodiments, such scatter symbols may provide and/or cause one or more secondary payouts to a player irrespective of their location in the primary outcome area 722 and/or irrespective of their relative orientation to each other.

According to some embodiments, one or more of the symbols 730 may comprise primary connecting symbols 732*a-b*. As depicted for exemplary purposes only in FIG. 7A, the primary connecting symbols 732*a-b* may be provided in association with a theme such as a battleship theme. According to some embodiments, the primary connecting symbols 732*a-b* may provide and/or cause one or more secondary payouts and/or other benefits, such as based on their relative orientation to each other.

As depicted in FIG. 7B, for example, the example game interface 720 and/or the primary outcome area 722 may be depicted as and/or represent the primary outcome area 722 subsequent and/or in response to the quantity and/or orientation of the symbols 730 (and/or the primary connecting symbols 732*a-b*) thereof. The two depicted primary connecting symbols 732*a-b* may, due to their relative orientations and/or positions for example, cause a connecting thereof. As depicted in FIG. 7B, in some embodiments, the primary connecting symbols 732*a-b* may become "connected" by one or more secondary connecting symbols

734*a-b* (e.g., two (2) secondary connecting symbols 734*a-b* as depicted in the example of FIG. 7B). In the example depicted in FIG. 7B, for example, any reel positions oriented between the occurrences of the two primary connecting symbols 732*a-b* (e.g., positions "a-b" and "b-b") may be replaced, overlaid, and/or otherwise actually or virtually changed into one or more of the secondary connecting symbols 734*a-b*. In some embodiments in other words, the reel positions (e.g., "gaps") between two or more occurrences of the primary connecting symbols 732*a-b* may be filled with, and/or the primary connecting symbols 732*a-b* may be "connected" by, one or more secondary connecting symbols 734*a-b*.

In some embodiments, the number of secondary connecting symbols 734*a-b* (e.g., required to fill any gaps between primary connecting symbols 732*a-b*) may influence one or more benefits such as a secondary payout provided to the player. The player may, for example, receive one or more primary winning outcomes, results, and/or payouts based on positions and/or occurrences of the game symbols 730 along one or more of the paylines 726*a-c*. The player may also, in accordance with some embodiments, receive one or more secondary winning outcomes, results, and/or payouts based on positions and/or occurrences of the primary connecting symbols 732*a-b* along one or more of the paylines 726*a-c* and/or positions and/or occurrences of the secondary connecting symbols 734*a-b* along one or more of the paylines 726*a-c*.

According to some embodiments, such as in the battleship theme depicted in FIG. 7A and FIG. 7B, the total resulting number of connecting symbols 734*a-b* may be indicative of a bonus and/or other win magnitude, amount, and/or achievement. In the particular case depicted for exemplary purposes in FIG. 7B, for example, the player may be deemed to have 'sunk' a battleship (and/or other ship or object represented by four (4) icons, health points, hit points, etc.)—e.g., of another player (such as in a tournament or head-to-head play, and/or as an achievement in a bonus and/or secondary game). This may, for example, be a preferred and/or better outcome than in the case that only a single secondary connecting symbol 732*a* was needed to connect or bridge the two primary connecting symbols 732*a-b*—e.g., which may be considered a sinking of a three (3)-size ship such as a cruiser or submarine. In some embodiments, the connecting of various primary connecting symbols 732*a-b* may occur on and/or along any of the paylines 726*a-c*. And while the paylines 726*a-c* are depicted for ease of reference as horizontal and/or simple paylines, varying geometries, paths, orientations, and/or configurations of paylines as are or become known or practicable may be utilized without deviating from the scope of some embodiments. Secondary connecting symbols 734*a-b* may, for example, be utilized to connect occurrences of two or more primary connecting symbols 732*a-b* in one or more horizontal (as depicted), vertical, diagonal, and/or combinations of orientations or directions.

In some embodiments, the relative number of primary connecting symbols 732*a-b* compared to secondary connecting symbols 734*a-b* may alter a given outcome, result, payout, and/or other benefit. In the case that a second secondary connecting symbol 734*b* was actually an original third primary connecting symbol (not depicted) and only a single secondary connecting symbol 734*a* would be required to connect/complete the four (4)-position "sinking", for example, a higher, better, and/or larger outcome, result, payout, and/or benefit may be provided—e.g., the player may be deemed to have achieved a better result by "hitting" the battleship three (3) times (as opposed to only two (2)), therefore only requiring a single "shot" to complete the sinking (i.e., the first secondary connecting symbol 734*a*). In some embodiments, the number of available "extra shots" or "helping shots" that connect actual "hits" (e.g., represented by secondary connecting symbols 734*a-b*) may be earned (e.g., from primary game reel symbols 730 and/or bonus game achievements), purchased (e.g., "freemium"), and/or randomly allocated, banked, etc. According to some embodiments, a player may be given the option to choose when (and/or how) to utilize such secondary connecting symbols 734*a-b*.

Figure 8:
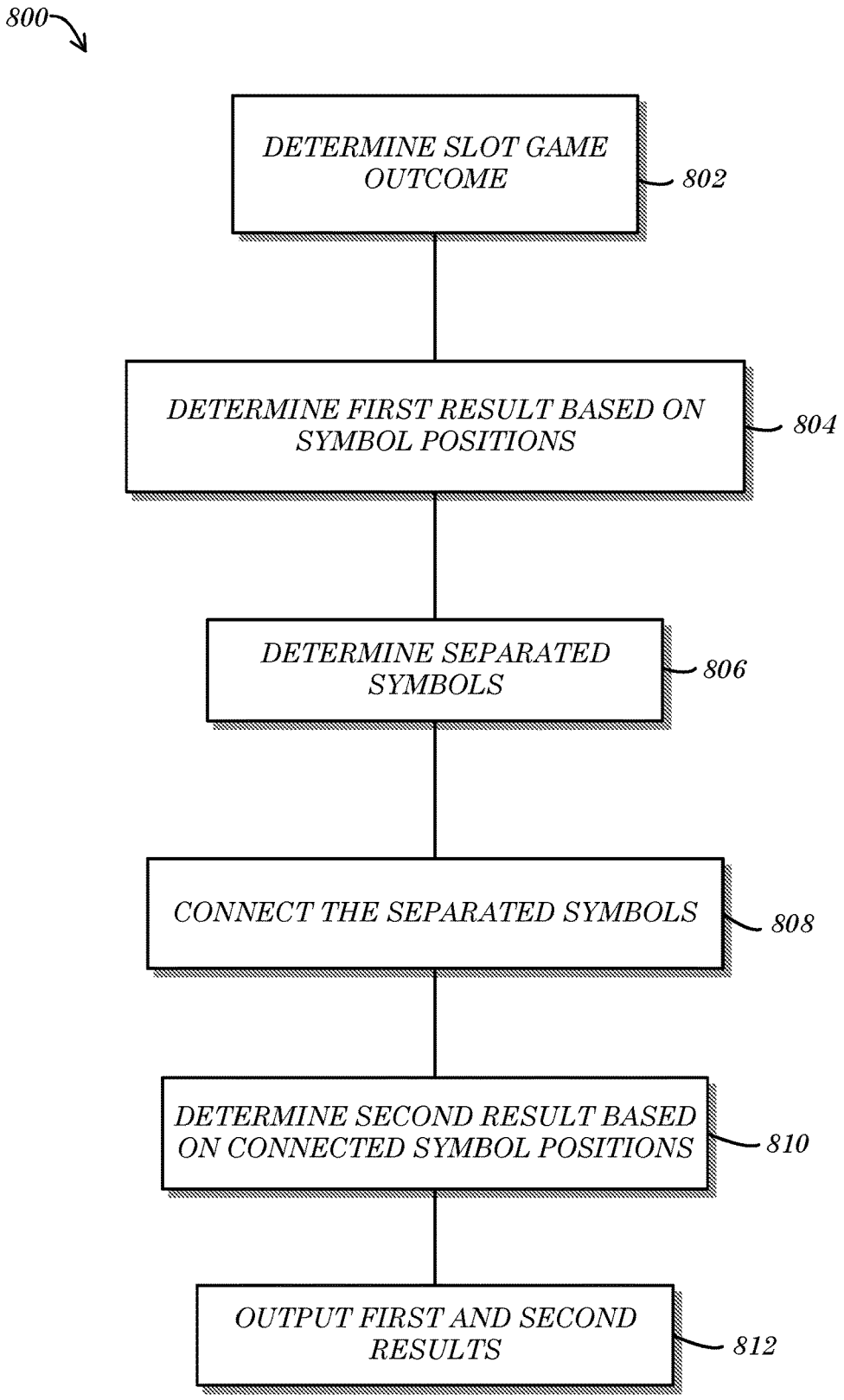
FIG. 8 is a flow diagram of a method according to some embodiments.

Turning now to FIG. 8, a flow diagram of a method 800 according to some embodiments is shown. In some embodiments, the method 800 may be implemented, facilitated, and/or performed by or otherwise associated with the systems 100, 200, 300, 400, 500 of FIG. 1, FIG. 2, FIG. 3, FIG. 4, and/or FIG. 5 herein (and/or portions thereof, such as the user devices 102*a-n*, 202*a-n*, 302*a-b*, 402, 502 and/or the servers 110, 210*a-n*, 310*a-g*, 410*e-f*, 510*a-j*).

The process diagrams and flow diagrams described herein do not necessarily imply a fixed order to any depicted actions, steps, and/or procedures, and embodiments may generally be performed in any order that is practicable unless otherwise and specifically noted. Any of the processes and methods described herein may be performed and/or facilitated by hardware, software (including microcode), firmware, or any combination thereof. For example, a storage medium (e.g., a hard disk, Random Access Memory (RAM) device, cache memory device, Universal Serial Bus (USB) mass storage device, and/or Digital Video Disk (DVD); e.g., the data storage devices 140, 240*a-f*, 540, 1140, 1240*a-e* of FIG. 1, FIG. 2, FIG. 5, FIG. 11, FIG. 12A, FIG. 12B, FIG. 12C, FIG. 12D, and/or FIG. 12E herein) may store thereon instructions that when executed by a machine (such as a computerized processor) result in performance according to any one or more of the embodiments described herein.

According to some embodiments, the method 800 may comprise determining a slot game outcome, at 802. The slot game may, for example, comprise a wagering, casual, social network, multiplayer, and/or online game such as a "battleship"-themed (and/or Battleship®-themed) game. The slot game outcome may accordingly be random, pseudo-random, skill, and/or otherwise based, including combinations thereof. According to some embodiments, the outcome may comprise an indication, output, and/or graphical display of a plurality of symbols. In some embodiments, the symbols may be disposed at various particular positions on one or more virtual, physical, and/or other slot-style reels. The outcome may comprise, for example, a matrix of symbols and/or associated values (e.g., as depicted in the interfaces 620, 720, 920*a-d*, 1020*a-e* of FIG. 6, FIG. 7, FIG. 9A, FIG. 9B, FIG. 9C, FIG. 9D, FIG. 10A, FIG. 10B, FIG. 10C, FIG. 10D, and/or FIG. 10E herein). The outcome may generally be defined as a result of a particular spin, game play, session, and/or other game play-related occurrence.

In some embodiments, the method 800 may comprise determining a first result for the game, at 804. The first result may, for example, generally be determined in any known and/or desired manner such as by resolving one or more paylines in accordance with the outcome matrix to determine one or more payouts, wins, and/or other first results for the game. In some embodiments, the first result(s) may be utilized, along with a first paytable, to determine one or more first payouts, win amounts, and/or other prizes and/or achievements due to a player of the game (e.g., as a first result of the particular spin and/or game play).

According to some embodiments, the method 800 may comprise determining separated symbols, at 806. Symbols from the outcome may be analyzed (e.g., by a processing device), for example, to determine whether such symbols can and/or should be "connected". Two non-adjacent symbols of a particular type (e.g., a first type), for example, may be positioned (e.g., first and second particular positions) such that one, two, or three positions disposed there between are populated with symbols of one or more different types (e.g., a second type). In some embodiments, such as in the case that game rules and/or processing instructions allow for such non-adjacent symbol to be "connected", such symbols may be referred to as primary connecting symbols (e.g., the primary connecting symbols 632, 732*a-b*, 932*a-c* of FIG. 6, FIG. 7A, FIG. 7B, FIG. 9A, FIG. 9B, FIG. 9C, and/or FIG. 9D herein). According to some embodiments, a determination of whether such symbols may be connected may be based (at least partially) on the type of primary connecting symbols. In accordance with the non-limiting "battleship" theme provided as an example herein, for example, two "submarine" (e.g. a three-position/hit point game piece) type symbols may be eligible for connection in the case that only a single non-submarine type symbol occurs between the two submarine symbols (e.g., but not if more than one non-like symbol appears there between). Similarly, in accordance with some example embodiments, two "battleship" (e.g. a four-position/hit point game piece) type symbols may be eligible for connection in the case that either one or two non-battleship type symbols occur between the two battleship symbols (e.g., but not if more than two non-like symbols appear there between). According to some embodiments, once it is determined that two or more symbols from the outcome matrix are eligible for connection, it may be determined whether such symbols should be connected. Game rules and/or stored instructions may define, for example, how and/or when occurrences of primary connecting symbols may be connected. In some embodiments, such a determination may be based at least in part on game play characteristics and/or game features applicable to a particular player, player account, game play device, etc. In the case that a player must earn and/or purchase secondary connecting symbols, for example, and the player has not done so, then the eligible primary connecting symbols may not be connected. In the case that the player has earned, purchased, and/or otherwise acquired access to an appropriate quantity of secondary connecting symbols, the primary connecting symbols may be "connected" by placing (e.g., superimposing, replacing, etc.) the secondary connecting symbols on and/or within the outcome matrix. According to some embodiments, a player may choose (and provide indications thereof—such indications being received by a processing device associated with the game)

In some embodiments, the method 800 may comprise connecting the separated symbols, at 808. In the case that it is determined that the primary connecting symbols can (e.g., are eligible) and should (e.g., secondary connecting symbols are available and/or desired for utilization) be utilized, for example, one or more secondary connecting symbols may be disposed there between to effectively "connect" the primary connecting symbols—e.g., creating a continuous/consecutive string of like-symbols. In some embodiments, the connecting may comprise outputting an indication of the connecting. One or more secondary connecting symbols may be shown to replace, overlay, and/or otherwise appear in place of, for example, one or more symbols of the symbol matrix (e.g., at one or more third particular positions). In some embodiments, the one or more secondary connecting symbols may be specially highlighted, animated, and/or otherwise distinguished to attract focus regarding their utilization.

According to some embodiments, the method 800 may comprise determining a second result for the game, at 810. The second result may, for example, be based on the positions (e.g., first, second, and third particular positions) of the connecting symbols, such as the number of consecutive and/or adjacent connecting symbols (e.g., linearly, diagonally, and/or otherwise along one or more particular paylines). In some embodiments, the second result may be determined by utilizing a second paytable that is different than the first paytable—e.g., a paytable specifically setup for determining win amounts/payouts for connecting symbol occurrences/outcomes. According to some embodiments, the same paytable that is utilized to determine the first result at 802 may be utilized to determine the second result at 810. In some embodiments, the second result may comprise a secondary result of a primary game (e.g., the slot-style game), a result of a secondary game, and/or a result of a bonus round or game associated with the primary game. According to some embodiments, the second result may comprise a result of a multiplayer online tournament and/or game that utilizes the underlying primary slot-style game as a basis for determining player actions in the multiplayer game. In the ongoing "battleship"-themed example, for example, a first player's slot-style, symbol-based results (e.g., first results and/or second results) may be utilized to determine a number of shots fired by the first player, locations of shots fired by the first player, a number of hits made by the first player, a type of hit made by the first player (e.g., type of vessel struck), and/or a sinking of a second player's vessel(s).

In some embodiments, the method 800 may comprise outputting the first and second results, at 812. The first and/or second results may be output to the player of the slot-style game, for example, via a Graphical User Interface (GUI) and/or other interfaces associated with play of the game. The results may be output, for example, via one or more of the interfaces 620, 720, 920*a-d*, 1020*a-e* of FIG. 6, FIG. 7, FIG. 9A, FIG. 9B, FIG. 9C, FIG. 9D, FIG. 10A, FIG. 10B, FIG. 10C, FIG. 10D, and/or FIG. 10E herein. According to some embodiments, the first and/or second results may be utilized to further determine an outcome (and/or result) for a bonus and/or multiplayer game. The player may receive winnings for each of the first and second results, for example, and the second result may further influence and/or govern play of a bonus, secondary, and/or multiplayer game such as the multiplayer-networked "battleship" game utilized as an example herein.

Turning to FIG. 9A, FIG. 9B, FIG. 9C, and FIG. 9D, example interfaces 920*a-d* according to some embodiments are shown. In some embodiments, the interfaces 920*a-d* may comprise a web page, web form, database entry form, Application Programming Interface (API), spreadsheet, table, and/or application or other GUI via which a game may be accessed and/or played. The interfaces 920*a-d* may, for example, comprise a front-end of a social network game, wagering game, casual game, and/or online gaming program (and/or portion thereof) and/or platform programmed and/or otherwise configured to execute, conduct, and/or facilitate the method 800 of FIG. 8, and/or portions thereof. In some embodiments, the interfaces 920*a-d* may be output via a computerized device such as one or more of the user devices 102*a-n*, 202*a-n*, 302*a-b*, 402, 502 and/or the servers 110,

210*a-n*, 310*a-g*, 410*e-f*, 510*a-j* of FIG. 1, FIG. 2, FIG. 3, FIG. 4, and/or FIG. 5 herein. In some embodiments, the example interfaces 920*a-d* may comprise interface outputs of (and/or otherwise associated with) a GUI utilized to play a game having and/or including connecting game symbols (and/or associated rewards and/or prizes) described herein.

A first example interface 920*a* as depicted in FIG. 9A, for example, may provide a slot-style primary game area 922 comprising a plurality of slot reels (virtual, mechanical, etc.) 924*a-e*. In some embodiments, a winning result in the slot-style game may be determined in accordance with a first payline 926*a* (e.g., payline number "6"). Along the first payline 926*a*, for example, three (3) diagonally-adjacent "battleship" symbols 932*a-c* may comprise a winning result and/or be indicative of a winning outcome. According to some embodiments, the first example interface 920*a* may comprise a betting area 962 (e.g., that indicates and/or allows changes to the size of wager/play amount and/or number of paylines played), a first win area 966*a* (e.g., that indicates that the first payline 926*a* has won eight hundred and seventy-five (875) units—which may also or alternatively be reflected in the graphic depicting a first one of the winning "battleship" symbols 932*a*), a second win area 966*b* (e.g., that indicate a total win amount—e.g., across a plurality of spins, wagers, plays, and/or game sessions), and/or a paytable area 968 (e.g., that allows a user to view, access, and/or interact with one or more paytables applicable to the slot-style game for which the first example interface 920*a* comprises an output indication of).

In some embodiments, a second example interface 920*b* as depicted in FIG. 9B may also or alternatively provide an indication of a slot-style game. The second example interface 920*b* may, for example, comprise an alternate, previous, subsequent, and/or modified version of the first example interface 920*a*. The second example interface 920*b*, in accordance with some embodiments, may comprise a second payline 926*b* (e.g., payline number "2"). In some embodiments, the second payline 926*b* may indicate a winning result (and/or associated outcome) occurring horizontally across the second portion of all slot reels 924*a-e*. The winning result may comprise, for example, a first primary connecting symbol 932*a* on the first reel 924*a*, a second primary connecting symbol 932*b* on the third reel 924*c*, and/or a third connecting symbol 932*c* on the fifth reel 924*e*. According to some embodiments, the win from the second payline 926*b* indicated in the first win area 966*a* may be greater than the win indicated for the first payline 926*a* of FIG. 9A (e.g., ten thousand five hundred (10,500) units as opposed to eight hundred and seventy-five (875) units)—e.g., in accordance with a paytable available via and/or associated with the paytable area 968.

In some embodiments, the winning result may comprise a connecting and/or linking of the primary connecting symbols 932*a-c*. A first secondary connecting symbol 934*a* may occur between the first primary connecting symbol 932*a* and the second primary connecting symbol 932*b*, for example, and/or a second secondary connecting symbol 934*b* may occur between the second primary connecting symbol 932*b* and the third primary connecting symbol 934*c*. In some embodiments, the secondary connecting symbols 934*a-b* may replace any original symbols at the same reel positions or may be placed, overlaid, and/or otherwise disposed over or near any originally-occurring symbol (e.g., without actually replacing such symbols). According to some embodiments, a player may choose when and/or how one or more available secondary connecting symbols 934*a-b* may be utilized and/or implemented (e.g., when and/or where one or more secondary connecting symbols 934*a-b* should be placed on the reels 924*a-e*). In some embodiments, one or more special and/or secondary results and/or associated outcomes may be output in response to the "connecting" of more than a pre-determined threshold number of like symbols, such as the five (5) "connected" symbols comprising the primary connecting symbols 932*a-c* and the secondary connecting symbols 934*a-b*.

According to some embodiments for example, a third example interface 920*c* as depicted in FIG. 9C may also or alternatively provide a depiction of the slot-style game comprising a first on-reel bonus block 936*a*. The first on-reel bonus block 936*a* may, for example, be overlaid upon and/or replace the first and second primary connecting symbols 932*a-b* and the secondary connecting symbols 934*a-b* (each depicted in FIG. 9B). In the depicted example, the first on-reel bonus block 936*a* may represent a secondary and/or bonus win achieved by "connecting" a minimum threshold of four (4) "battleship" game symbols. According to some embodiments, the secondary and/or bonus win associated with and/or represented by the first on-reel bonus block 936*a* may be larger in magnitude than a standard win along the second payline 926*b*. The first on-reel bonus block 936*a* may be associated with, for example, the depicted seventeen thousand five hundred (17,500) unit win, as opposed to the ten thousand five hundred (10,500) units depicted in FIG. 9B.

In some embodiments, a fourth example interface 920*d* as depicted in FIG. 9D may also or alternatively provide a representation of an output of the slot-style game. The fourth example interface 920*d* may, for example, depict an alternate and/or additional manner of outputting an indication of a win (e.g., primary, secondary, and/or bonus) associated with the second payline 926*b* of FIG. 9B. The second and third primary connecting symbols 932*b-c* and the secondary connecting symbols 934*a-b* (each depicted in FIG. 9B) may, in some embodiments, be overlaid and/or replaced by a second on-reel bonus block 936*b*. As depicted, the second on-reel bonus block 936*b* may represent a hit and/or sinking of a "battleship"—e.g., based on the "connecting" of four (4) or more "battleship" symbols. In some embodiments, the number of secondary connecting symbols 934*a-b* utilized to achieve and/or obtain the on-reel bonus blocks 936*a-b* may influence and/or determine one or more effects of the associated winning result. In the case that an on-reel bonus block 936*a-b* is achieved without need for any secondary connecting symbols 934*a-b*, for example, the result may comprise a "sinking" of a battleship—e.g., a bonus win event and/or a sinking of an opponent's ship, such as in a multiplayer "battleship"-themed slot-style game. In the case that one or more secondary connecting symbols 934*a-b* are required to "connect" the "battleship" symbols to achieve the on-reel bonus blocks 936*a-b*, the winning result may comprise one or more "hits" on a "battleship" game piece. In some embodiments, the number of "hits" may be equal to the number of primary connecting symbols 932*a-c* utilized to achieve the on-reel bonus blocks 936*a-b* (i.e., two (2) hits as per the examples depicted in the example interfaces 920*b-d* of FIG. 9B, FIG. 9C, and FIG. 9D.

Turning to FIG. 10A, FIG. 10B, FIG. 10C, FIG. 10D, and FIG. 10E, example interfaces 1020*a-e* according to some embodiments are shown. In some embodiments, the interfaces 1020*a-e* may comprise a web page, web form, database entry form, API, spreadsheet, table, and/or application or other GUI via which a game may be accessed and/or played. The interfaces 1020*a-e* may, for example, comprise a front-end of a social network game, wagering game, casual game, and/or online gaming program (and/or portion thereof) and/or platform programmed and/or otherwise configured to execute, conduct, and/or facilitate the method 800 of FIG. 8, and/or portions thereof. In some embodiments, the interfaces 1020*a-e* may be output via a computerized device such as one or more of the user devices 102*a-n*, 202*a-n*, 302*a-b*, 402, 502 and/or the servers 110, 210*a-n*, 310*a-g*, 410*e-f*, 510*a-j* of FIG. 1, FIG. 2, FIG. 3, FIG. 4, and/or FIG. 5 herein. In some embodiments, the example interfaces 920*a-e* may comprise interface outputs of (and/or otherwise associated with) a GUI utilized to play a game having and/or including connecting game symbols (and/or associated rewards and/or prizes) described herein.

A first example interface 1020*a* as depicted in FIG. 10A, for example, may provide a slot-style primary game area 1022 comprising a plurality of slot reels (virtual, mechanical, etc.) 1024*a-e* and/or a secondary game area 1028 (e.g., displaying an indication of one or more secondary payouts, games, and/or bonus features). In some embodiments, the primary game area 1022 may comprise a first secondary win indicator 1036*a* (e.g., a "patrol boat" and/or other two-position/hit-point object; that may be associated with and/or also represented by data output via the secondary game area 1028). According to some embodiments, the first example interface 1020*a* may also or alternatively comprise a game play actuation area 1060 (e.g., that provides an input mechanism that allows game play to be initiated), a first betting area 1062*a* (e.g., that provides an input mechanism that allows for changes to the size of wager/play amount), a second betting area 1062*b* (e.g., that provides an input mechanism that allows for changes to the number of paylines played), a third betting area 1062*c* (e.g., that indicates any selections and/or settings associated with the first betting area 1062*a* and/or the second betting area 1062*b*), a fourth betting area 1062*d* (e.g., that provides an input mechanism that allows for a maximum wager, bet, and/or play magnitude feature to be selected), a first win area 1066*a* (e.g., that indicates that the secondary win indicator 1036*a* is associated with a win of seven hundred (700) units—which may also or alternatively be reflected in the graphic depicting the secondary win indicator 1036*a*), a second win area 1066*b* (e.g., that indicate a total win amount—e.g., across a plurality of spins, wagers, plays, and/or game sessions), and/or a paytable area 1068 (e.g., that allows a user to view, access, and/or interact with one or more paytables applicable to the slot-style game for which the first example interface 1020*a* comprises an output indication of).

In some embodiments, a second example interface 1020*b* as depicted in FIG. 10B may also or alternatively provide a second secondary win indicator 1036*b* (e.g., a "destroyer" and/or other three-position/hit-point object). As depicted, the second secondary win indicator 1036*b* may be associated with a winning result larger than the result associated with the first secondary win indicator 1036*a* (e.g., a win amount of one thousand seven hundred and fifty (1,750) units as opposed to seven hundred (700) units). In some embodiments, the second secondary win indicator 1036*b* and/or associated three-position win object may comprise the smallest chain of adjacent and/or consecutive connecting symbols that may utilize secondary connecting symbols to "fill-in" gaps in the consecutive and/or adjacent symbol sequence.

According to some embodiments, a third example interface 1020*c* as depicted in FIG. 10C may also or alternatively provide a third secondary win indicator 1036*c* (e.g., a "submarine" and/or other three-position/hit-point object). As depicted, the third secondary win indicator 1036*c* may be associated with a winning result larger than the result associated with the second secondary win indicator 1036*b* (e.g., a win amount of three thousand five hundred (3,500) units as opposed to one thousand seven hundred and fifty (1,750) units).

In some embodiments, a fourth example interface 1020*d* as depicted in FIG. 10D may also or alternatively provide a fourth secondary win indicator 1036*d* (e.g., a "battleship" and/or other four-position/hit-point object). As depicted, the fourth secondary win indicator 1036*d* may be associated with a winning result larger than the result associated with the third secondary win indicator 1036*c* (e.g., a win amount of seventeen thousand five hundred (17,500) units as opposed to three thousand five hundred (3,500) units).

According to some embodiments, a fifth example interface 1020*e* as depicted in FIG. 10E may also or alternatively provide a fifth secondary win indicator 1036*e* (e.g., a "carrier" and/or other five-position/hit-point object). As depicted, the fifth secondary win indicator 1036*e* may be associated with a winning result larger than the result associated with the fourth secondary win indicator 1036*d* (e.g., a win amount of thirty-five thousand (35,000) units as opposed to seventeen thousand five hundred (17,500) units).

While various components of the interfaces 920*a-d*, 1020*a-e* have been depicted with respect to certain labels, layouts, headings, titles, and/or configurations, these features have been presented for reference and example only. Other labels, layouts, headings, titles, and/or configurations may be implemented without deviating from the scope of embodiments herein. Similarly, while a certain number of tabs, information screens, form fields, and/or data entry options have been presented, variations thereof may be practiced in accordance with some embodiments.

Figure 11:
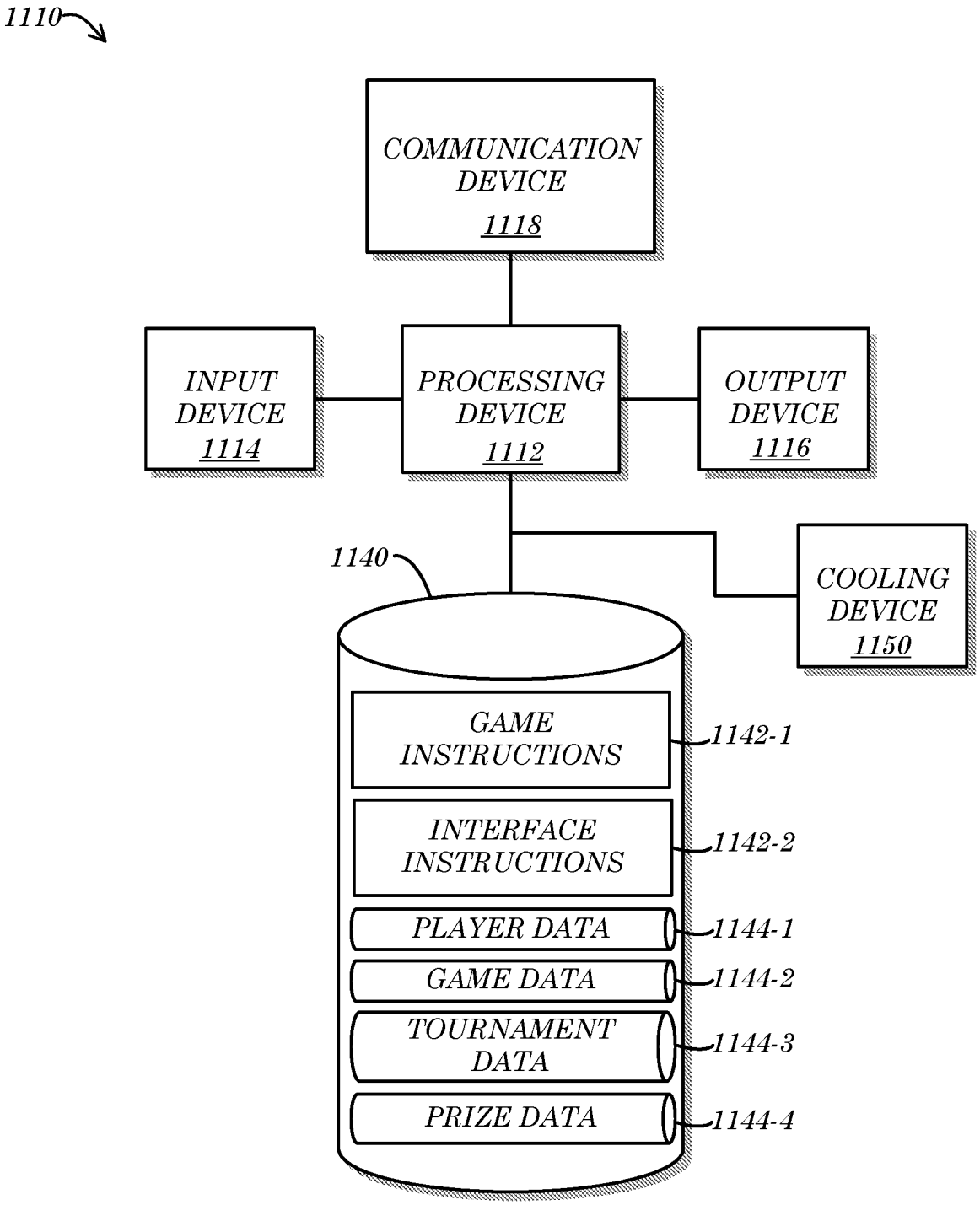
FIG. 11 is a block diagram of an apparatus according to some embodiments.
Figure 12A:
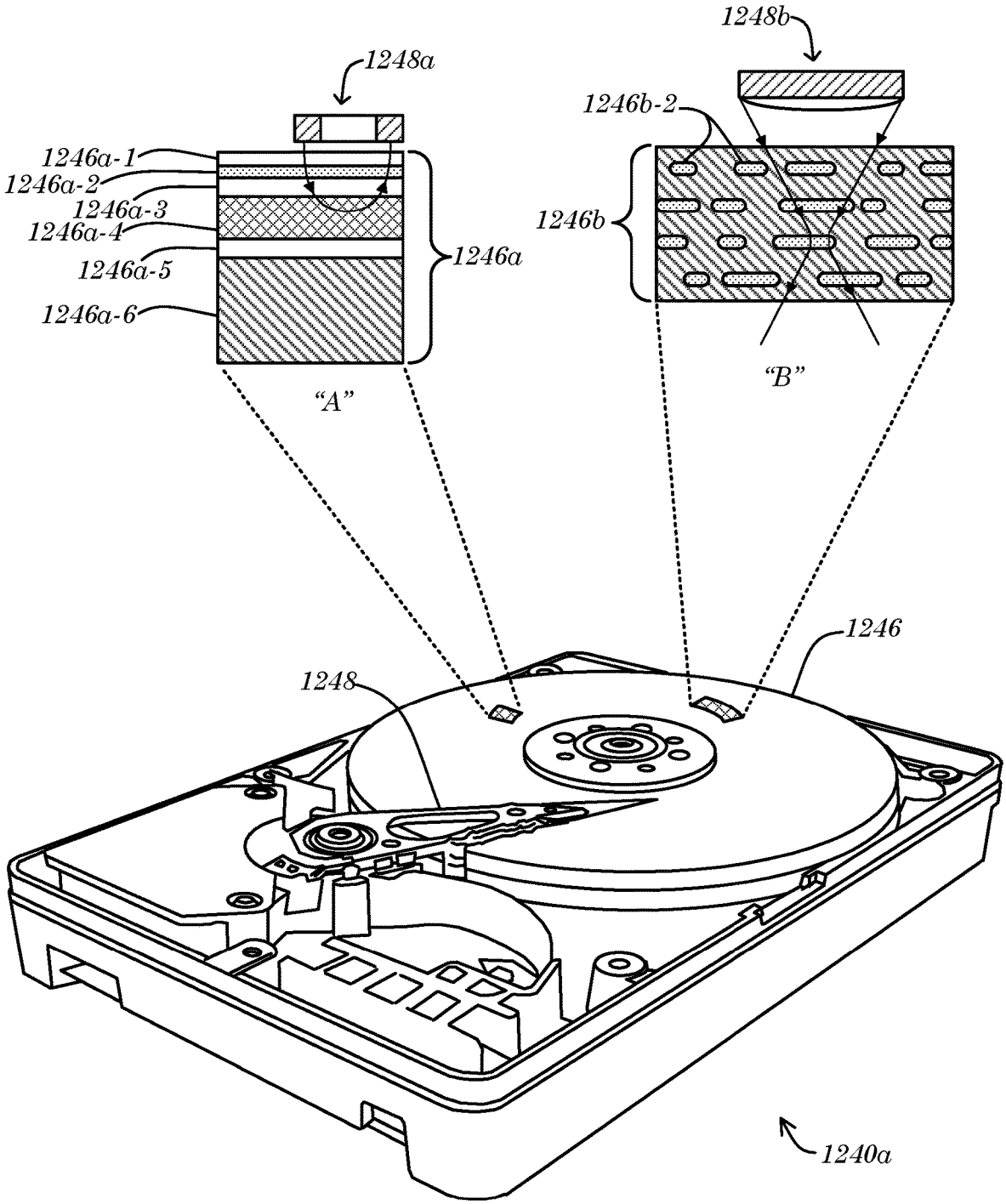
FIG. 12A, FIG. 12B, FIG. 12C, FIG. 12D, and FIG. 12E are perspective diagrams of exemplary data storage devices according to some embodiments.
Figure 12B:
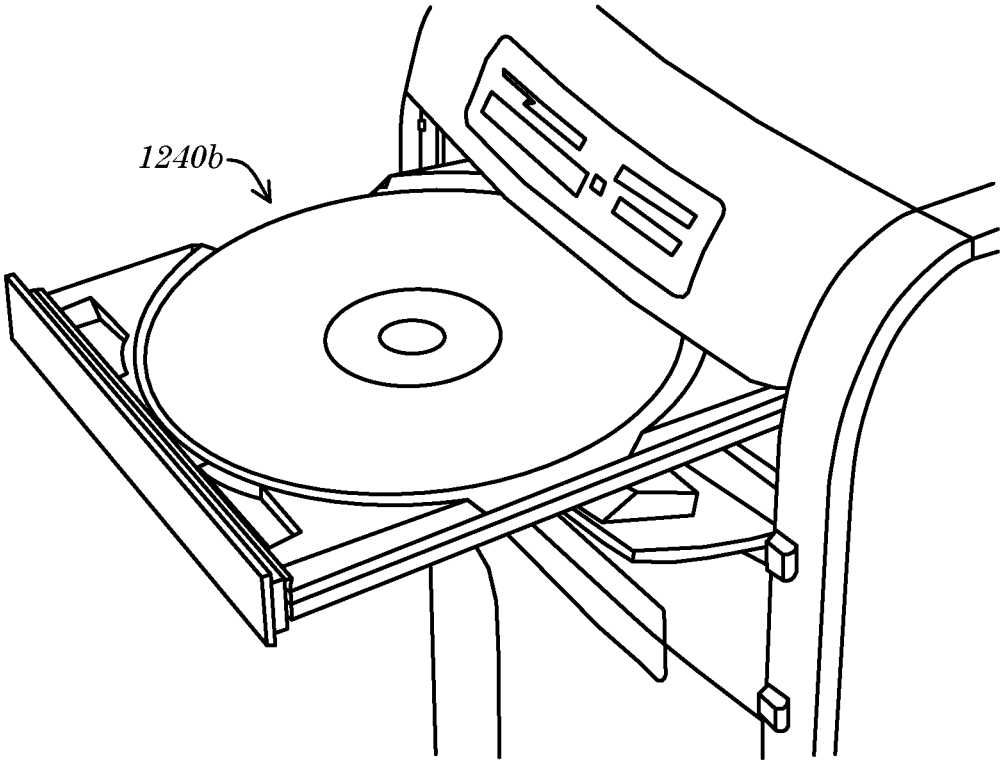
Figure 12C:
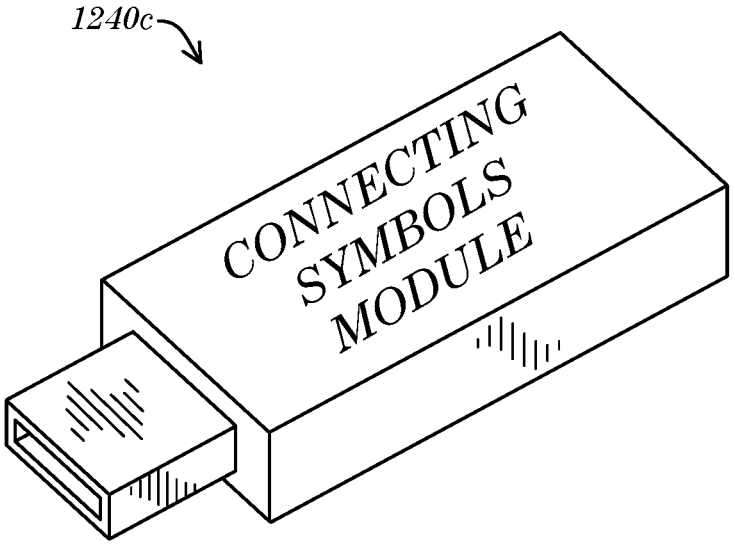
Figure 12D:
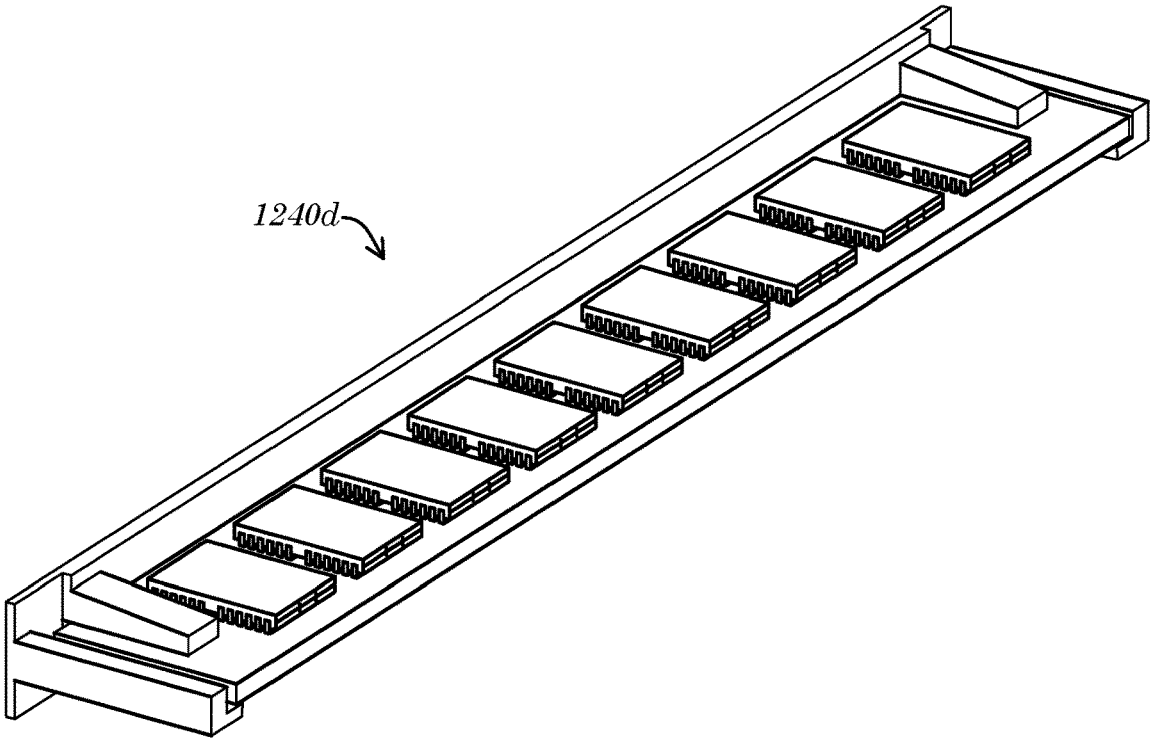
Figure 12E:
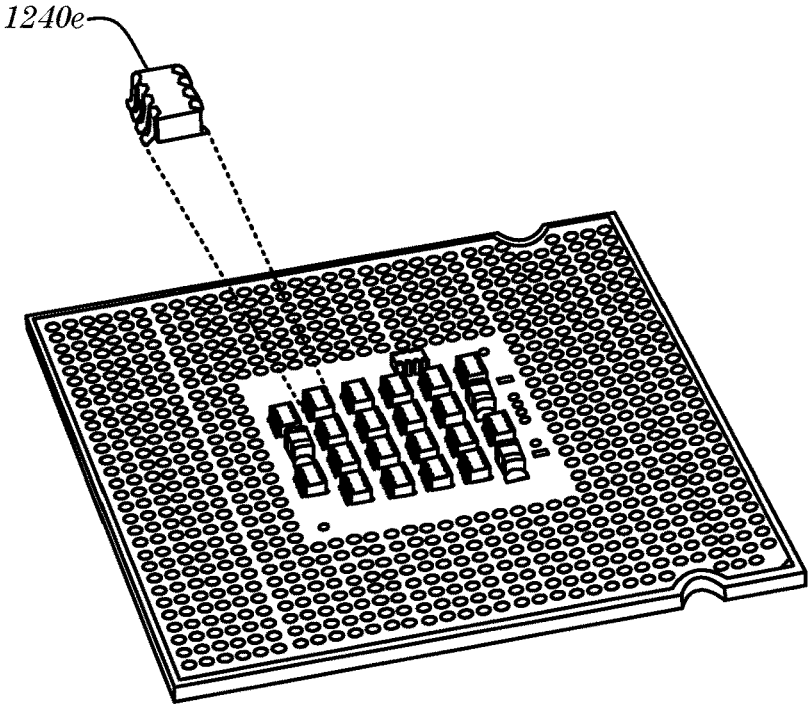

Turning to FIG. 11, a block diagram of an apparatus 1110 according to some embodiments is shown. In some embodiments, the apparatus 1110 may be similar in configuration and/or functionality to any of the player and/or user devices 102*a-n*, 202*a-n*, 302*a-b*, 402, 502 and/or the servers and/or controller devices 110, 210*a-n*, 310*a-g*, 410*e-f*, 510*a-j* of FIG. 1, FIG. 2, FIG. 3, FIG. 4, and/or FIG. 5 herein, and/or may otherwise comprise a portion of the systems 100, 200, 300, 400, 500 of FIG. 1, FIG. 2, FIG. 3, FIG. 4, and/or FIG. 5 herein. The apparatus 1110 may, for example, execute, process, facilitate, and/or otherwise be associated with the method 800 of FIG. 8 and/or other various methods described herein, and/or any portions and/or combinations thereof. In some embodiments, the apparatus 1110 may comprise a processing device 1112, an input device 1114, an output device 1116, a communication device 1118, a memory device 1140, and/or a cooling device 1150. According to some embodiments, any or all of the components 1112, 1114, 1116, 1118, 1140, 1150 of the apparatus 1110 may be similar in configuration and/or functionality to any similarly named and/or numbered components described herein. Fewer or more components 1112, 1114, 1116, 1118, 1140, 1150 and/or various configurations of the components 1112, 1114, 1116, 1118, 1140, 1150 be included in the apparatus 1110 without deviating from the scope of embodiments described herein.

According to some embodiments, the processing device 1112 may be or include any type, quantity, and/or configuration of electronic and/or computerized processor that is or becomes known. The processing device 1112 may comprise, for example, an Intel® IXP 2800 network processor or an Intel® XEON™ Processor coupled with an Intel® E7501 chipset. In some embodiments, the processing device 1112 may comprise multiple inter-connected processors, microprocessors, and/or micro-engines. According to some embodiments, the processing device 1112 (and/or the apparatus 1110 and/or portions thereof) may be supplied power via a power supply (not shown) such as a battery, an Alternating Current (AC) source, a Direct Current (DC) source, an AC/DC adapter, solar cells, and/or an inertial generator. In the case that the apparatus 1110 comprises a server such as a blade server, necessary power may be supplied via a standard AC outlet, power strip, surge protector, a PDU, and/or Uninterruptible Power Supply (UPS) device.

In some embodiments, the input device 1114 and/or the output device 1116 are communicatively coupled to the processing device 1112 (e.g., via wired and/or wireless connections and/or pathways) and they may generally comprise any types or configurations of input and output components and/or devices that are or become known, respectively. The input device 1114 may comprise, for example, a keyboard that allows an operator of the apparatus 1110 to interface with the apparatus 1110 (e.g., by a player, such as to participate in an online game session as described herein). In some embodiments, the input device 1114 may comprise a sensor configured to provide information such as player relationships to the apparatus 1110 and/or the processing device 1112. The output device 1116 may, according to some embodiments, comprise a display screen and/or other practicable output component and/or device. The output device 1116 may, for example, provide a game interface (not explicitly shown in FIG. 11; e.g., the interfaces 620, 720, 920*a-d*, 1020*a-e* of FIG. 6, FIG. 7, FIG. 9A, FIG. 9B, FIG. 9C, FIG. 9D, FIG. 10A, FIG. 10B, FIG. 10C, FIG. 10D, and/or FIG. 10E herein) to a player (e.g., via a website). According to some embodiments, the input device 1114 and/or the output device 1116 may comprise and/or be embodied in a single device such as a touch-screen monitor.

In some embodiments, the communication device 1118 may comprise any type or configuration of communication device that is or becomes known or practicable. The communication device 1118 may, for example, comprise a NIC, a telephonic device, a cellular network device, a router, a hub, a modem, and/or a communications port or cable. In some embodiments, the communication device 1118 may be coupled to provide data to a player device (not shown in FIG. 11), such as in the case that the apparatus 1110 is utilized to provide a game interface to a player as described herein. The communication device 1118 may, for example, comprise a cellular telephone network transmission device that sends signals indicative of game interface components to customer and/or subscriber handheld, mobile, and/or telephone device. According to some embodiments, the communication device 1118 may also or alternatively be coupled to the processing device 1112. In some embodiments, the communication device 1118 may comprise an IR, RF, Bluetooth™, and/or Wi-Fi® network device coupled to facilitate communications between the processing device 1112 and another device (such as a player device and/or a third-party device).

The memory device 1140 may comprise any appropriate information storage device that is or becomes known or available, including, but not limited to, units and/or combinations of magnetic storage devices (e.g., a hard disk drive), optical storage devices, and/or semiconductor memory devices such as RAM devices, Read Only Memory (ROM) devices, Single Data Rate Random Access Memory (SDR-RAM), Double Data Rate Random Access Memory (DDR-RAM), and/or Programmable Read Only Memory (PROM). The memory device 1140 may, according to some embodiments, store one or more of game instructions 1142-1, interface instructions 1142-2, player data 1144-1, game data 1144-2, tournament data 1144-3, and/or prize data 1144-4. In some embodiments, the game instructions 1142-1, interface instructions 1142-2, player data 1144-1, game data 1144-2, tournament data 1144-3, and/or prize data 1144-4 may be utilized by the processing device 1112 to provide output information via the output device 1116 and/or the communication device 1118.

According to some embodiments, the game instructions 1142-1 may be operable to cause the processing device 1112 to process the player data 1144-1, game data 1144-2, tournament data 1144-3, and/or prize data 1144-4. Player data 1144-1, game data 1144-2, tournament data 1144-3, and/or prize data 1144-4 received via the input device 1114 and/or the communication device 1118 may, for example, be analyzed, sorted, filtered, decoded, decompressed, ranked, scored, plotted, and/or otherwise processed by the processing device 1112 in accordance with the game instructions 1142-1. In some embodiments, player data 1144-1, game data 1144-2, tournament data 1144-3, and/or prize data 1144-4 may be fed by the processing device 1112 through one or more mathematical and/or statistical formulas and/or models in accordance with the game instructions 1142-1 to provide online game sessions and/or implement, facilitate, and/or output associated and/or connecting game symbols, in accordance with embodiments described herein.

In some embodiments, the interface instructions 1142-2 may be operable to cause the processing device 1112 to process the player data 1144-1, game data 1144-2, tournament data 1144-3, and/or prize data 1144-4. Player data 1144-1, game data 1144-2, tournament data 1144-3, and/or prize data 1144-4 received via the input device 1114 and/or the communication device 1118 may, for example, be analyzed, sorted, filtered, decoded, decompressed, ranked, scored, plotted, and/or otherwise processed by the processing device 1112 in accordance with the interface instructions 1142-2. In some embodiments, player data 1144-1, game data 1144-2, tournament data 1144-3, and/or prize data 1144-4 may be fed by the processing device 1112 through one or more mathematical and/or statistical formulas and/or models in accordance with the interface instructions 1142-2 to provide online game sessions and/or implement, facilitate, and/or output associated and/or connecting game symbols, in accordance with embodiments described herein.

Any or all of the exemplary instructions and data types described herein and other practicable types of data may be stored in any number, type, and/or configuration of memory devices that is or becomes known. The memory device 1140 may, for example, comprise one or more data tables or files, databases, table spaces, registers, and/or other storage structures. In some embodiments, multiple databases and/or storage structures (and/or multiple memory devices 1140) may be utilized to store information associated with the apparatus 1110. According to some embodiments, the memory device 1140 may be incorporated into and/or otherwise coupled to the apparatus 1110 (e.g., as shown) or may simply be accessible to the apparatus 1110 (e.g., externally located and/or situated).

In some embodiments, the apparatus 1110 may comprise a cooling device 1150. According to some embodiments, the cooling device 1150 may be coupled (physically, thermally, and/or electrically) to the processing device 1112 and/or to the memory device 1140. The cooling device 1150 may, for example, comprise a fan, heat sink, heat pipe, radiator, cold plate, and/or other cooling component or device or combinations thereof, configured to remove heat from portions or components of the apparatus 1110.

Referring to FIG. 12A, FIG. 12B, FIG. 12C, FIG. 12D, and FIG. 12E, perspective diagrams of exemplary data storage devices 1240*a-e* according to some embodiments are shown. The data storage devices 1240*a-e* may, for example, be utilized to store instructions and/or data such as the game instructions 1142-1, interface instructions 1142-2, player data 1144-1, game data 1144-2, tournament data 1144-3, and/or prize data 1144-4, each of which is described in reference to FIG. 11 herein. In some embodiments, instructions stored on the data storage devices 1240*a-e* may, when executed by a processing device, cause the implementation of and/or facilitate the method 800 of FIG. 8 and/or portions thereof.

According to some embodiments, the first data storage device 1240*a* may comprise one or more various types of internal and/or external hard drives. The first data storage device 1240*a* may, for example, comprise a data storage medium 1246 that is read, interrogated, and/or otherwise communicatively coupled to and/or via a disk reading device 1248. In some embodiments, the first data storage device 1240*a* and/or the data storage medium 1246 may be configured to store information utilizing one or more magnetic, inductive, and/or optical means (e.g., magnetic, inductive, and/or optical-encoding). The data storage medium 1246, depicted as a first data storage medium 1246*a* for example (e.g., breakout cross-section "A"), may comprise one or more of a polymer layer 1246*a*-1, a magnetic data storage layer 1246*a*-2, a non-magnetic layer 1246*a*-3, a magnetic base layer 1246*a*-4, a contact layer 1246*a*-5, and/or a substrate layer 1246*a*-6. According to some embodiments, a magnetic read head 1246*a* may be coupled and/or disposed to read data from the magnetic data storage layer 1246*a*-2.

In some embodiments, the data storage medium 1246, depicted as a second data storage medium 1246*b* for example (e.g., breakout cross-section "B"), may comprise a plurality of data points 1246*b*-2 disposed with the second data storage medium 1246*b*. The data points 1246*b*-2 may, in some embodiments, be read and/or otherwise interfaced with via a laser-enabled read head 1248*b* disposed and/or coupled to direct a laser beam through the second data storage medium 1246*b*.

In some embodiments, the second data storage device 1240*b* may comprise a CD, CD-ROM, DVD, Blu-Ray™ Disc, and/or other type of optically-encoded disk and/or other storage medium that is or becomes know or practicable. In some embodiments, the third data storage device 1240*c* may comprise a USB keyfob, dongle, and/or other type of flash memory data storage device that is or becomes know or practicable. In some embodiments, the fourth data storage device 1240*d* may comprise RAM of any type, quantity, and/or configuration that is or becomes practicable and/or desirable. In some embodiments, the fourth data storage device 1240*d* may comprise an off-chip cache such as a Level 2 (L2) cache memory device. According to some embodiments, the fifth data storage device 1240*e* may comprise an on-chip memory device such as a Level 1 (L1) cache memory device.

The data storage devices 1240*a-e* may generally store program instructions, code, and/or modules that, when executed by a processing device cause a particular machine to function in accordance with one or more embodiments described herein. The data storage devices 1240*a-e* depicted in FIG. 12A, FIG. 12B, FIG. 12C, FIG. 12D, and FIG. 12E are representative of a class and/or subset of computer-readable media that are defined herein as "computer-readable memory" (e.g., non-transitory memory devices as opposed to transmission devices or media).

The terms "computer-readable medium" and "computer-readable memory" refer to any medium that participates in providing data (e.g., instructions) that may be read by a computer and/or a processor. Such a medium may take many forms, including but not limited to non-volatile media, volatile media, and other specific types of transmission media. Non-volatile media include, for example, optical or magnetic disks and other persistent memory. Volatile media include DRAM, which typically constitutes the main memory. Other types of transmission media include coaxial cables, copper wire, and fiber optics, including the wires that comprise a system bus coupled to the processor.

Common forms of computer-readable media include, for example, a floppy disk, a flexible disk, hard disk, magnetic tape, any other magnetic medium, a CD-ROM, Digital Video Disc (DVD), any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read. The terms "computer-readable medium" and/or "tangible media" specifically exclude signals, waves, and wave forms or other intangible or transitory media that may nevertheless be readable by a computer.

Various forms of computer-readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined above and includes many exemplary protocols that are also applicable here.

In some embodiments, one or more specialized machines such as a computerized processing device, a server, a remote terminal, and/or a customer device may implement the various practices described herein. A computer system of an gaming entity may, for example, comprise various specialized computers that interact to provide for online games as described herein The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

What is claimed is:

1. An online gaming system for playing an electronic slot-style game via a Graphical User Interface (GUI), the GUI providing output representing three virtual slot reels, each of the three virtual slot reels being automatically populated with three game symbols represented in a corresponding particular one of three positions on the respective virtual slot reel, and the GUI further providing a wagering input mechanism configured to receive selections of one or more of a wager size and a number of paylines to be played, comprising:

an electronic processing device;

a random number generator in communication with the electronic processing device;

an electronic display device in communication with the electronic processing device, the electronic display device being configured to display the output of the GUI, including the game symbols of the three slot reels and the wagering input mechanism; and a non-transitory memory device in communication with the electronic processing device, the non-transitory memory device storing (i) the game symbols and (ii) gameplay instructions that when executed by the electronic processing device result in:

generating, by the random number generator, a random number that defines a first outcome for a game event instance of the slot-style game;

identifying, by the electronic processing device and based on the first outcome for the game event instance of the slot-style game, the game symbols, the game symbols being indicative of the first outcome of the game event instance of the slot-style game;

outputting, via the electronic display device and in response to the identifying of the game symbols, a digital representation of one of the game symbols at each one of the particular positions of the virtual slot reels;

computing, by the electronic processing device and based on a first paytable of the slot-style game and based on the first outcome for the game event instance of the slot-style game, a first result of the slot-style game;

identifying, by the electronic processing device, a first primary connecting symbol at a first particular position on one of the slot reels;

identifying, by the electronic processing device, a second primary connecting symbol at a second particular position on one of the slot reels;

determining, by the electronic processing device, that a secondary connecting symbol should be disposed at a third particular position, wherein the determining comprises receiving, from a player of the slot-style game via the GUI, an indication of a request to utilize the secondary connecting symbol;

outputting, by the electronic display device, an indication of the secondary connecting symbol at the third particular position disposed between the first and second particular positions, the secondary connecting symbol at least one of: (i) being digitally overlaid on top of an original game symbol occurring at the third particular position, and (ii) electronically replacing the original game symbol occurring at the third particular position;

computing, by the electronic processing device and based on a second paytable of the slot-style game and based on the particular positions of the first and second primary connecting symbols and the secondary connecting symbol, a second result of the slot-style game, wherein the second result differs from the first result; and outputting, by the electronic display device, at least one indication of (i) the first result, and (ii) the second result.

2. The online gaming system of claim 1, wherein the gameplay instructions, when executed by the electronic processing device, further result in:

outputting, by the electronic display device and based on the particular positions of the first and second primary connecting symbols and the secondary connecting symbol, a win indicator.

3. The online gaming system of claim 2, wherein the win indicator comprises a graphic at least one of: (i) being digitally overlaid on top of the first and second primary connecting symbols and the secondary connecting symbol, and (ii) electronically replacing the first and second primary connecting symbols and the secondary connecting symbol.

4. The online gaming system of claim 1, wherein the determining that the secondary connecting symbol should be disposed at the third particular position, comprises:

determining that the secondary connecting symbol is available.

5. The online gaming system of claim 1, wherein the gameplay instructions, when executed by the electronic processing device, further result in:

determining, by the processing device and based on the second result, an outcome of a bonus game associated with the slot-style game.

6. The online gaming system of claim 5, wherein the outcome of the bonus game is further based on a characteristic of the secondary connecting symbol.

7. The online gaming system of claim 5, wherein the slot-style game is provided to a first player and wherein the outcome of the bonus game comprises a removal of a game piece from a set of game pieces of a second player.

8. The online gaming system of claim 1, wherein the first and second paytables are the same.

9. The online gaming system of claim 1, wherein the slot-style game comprises a primary game.

10. The online gaming system of claim 1, wherein the gameplay instructions, when executed by the electronic processing device, further result in:

providing, by the processing device, a payout based on the first and second results.

* * * * *